US011371108B2

(12) United States Patent
Na et al.

(10) Patent No.: US 11,371,108 B2
(45) Date of Patent: Jun. 28, 2022

(54) TOUGH IRON-BASED GLASSES WITH HIGH GLASS FORMING ABILITY AND HIGH THERMAL STABILITY

(71) Applicant: GlassiMetal Technology, Inc., Pasadena, CA (US)

(72) Inventors: Jong Hyun Na, Pasadena, CA (US); Kyung-Hee Han, Pasadena, CA (US); Marios D. Demetriou, West Hollywood, CA (US); William L. Johnson, San Marino, CA (US)

(73) Assignee: GlassiMetal Technology, Inc., Pasadena, CA (US)

( * ) Notice: Subject to any disclaimer, the term of this patent is extended or adjusted under 35 U.S.C. 154(b) by 46 days.

(21) Appl. No.: 16/719,838

(22) Filed: Dec. 18, 2019

(65) Prior Publication Data

US 2020/0263267 A1 Aug. 20, 2020

Related U.S. Application Data

(60) Provisional application No. 62/805,845, filed on Feb. 14, 2019.

(51) Int. Cl.

| | |
|---|---|
| ***C21D 6/00*** | (2006.01) |
| ***C22C 38/12*** | (2006.01) |
| ***C22C 33/04*** | (2006.01) |
| ***C22C 38/00*** | (2006.01) |
| ***C22C 38/08*** | (2006.01) |

(52) U.S. Cl.

CPC ..... *C21D 6/001* (2013.01); *C22C 33/04* (2013.01); *C22C 38/002* (2013.01); *C22C 38/08* (2013.01); *C22C 38/12* (2013.01)

(58) Field of Classification Search

None

See application file for complete search history.

(56) References Cited

U.S. PATENT DOCUMENTS

| | | | |
|---|---|---|---|
| 2,106,145 | A | 1/1938 | Floraday |
| 2,124,538 | A | 7/1938 | Boyer |
| 2,190,611 | A | 2/1940 | Sembdner |
| 3,322,546 | A | 5/1967 | Tanzman et al. |
| 3,539,192 | A | 11/1970 | Prasse |
| 3,558,846 | A | 1/1971 | Ujiie |
| 3,696,228 | A | 10/1972 | Thomas, Jr. et al. |
| 3,742,585 | A | 7/1973 | Wentzell |
| 3,776,297 | A | 12/1973 | Williford et al. |

(Continued)

FOREIGN PATENT DOCUMENTS

| | | |
|---|---|---|
| BR | PI 1010960-9 A2 | 4/2019 |
| BR | PI 1010960-9 B1 | 2/2020 |

(Continued)

OTHER PUBLICATIONS

"Interbike Buyer Official Show Guide", advertisement, 1995, 1 page.

(Continued)

*Primary Examiner* — Brian D Walck

(74) *Attorney, Agent, or Firm* — KPPB LLP

(57) ABSTRACT

The disclosure provides Fe—Cr—Ni—Mo—P—C—B metallic glass-forming alloys and metallic glasses that have a high glass forming ability along with a high thermal stability of the supercooled liquid against crystallization.

10 Claims, 21 Drawing Sheets

(56) References Cited

U.S. PATENT DOCUMENTS 3,856,513 A 12/1974 Chen et al.
3,948,613 A 4/1976 Weill
3,970,445 A 7/1976 Gale et al.
3,986,867 A 10/1976 Masumoto et al.
3,986,892 A 10/1976 Eve et al.
3,989,517 A 11/1976 Tanner et al.
4,024,902 A 5/1977 Baum
4,050,931 A 9/1977 Tanner et al.
4,064,757 A 12/1977 Hasegawa
4,067,732 A 1/1978 Ray
4,113,478 A 9/1978 Tanner et al.
4,115,682 A 9/1978 Kavesh et al.
4,116,682 A 9/1978 Polk et al.
4,116,687 A 9/1978 Hasegawa
4,124,472 A 11/1978 Riegert
4,125,737 A 11/1978 Andersson
4,126,284 A 11/1978 Ichikawa et al.
4,126,449 A 11/1978 Tanner et al.
4,135,924 A 1/1979 Tanner et al.
4,144,058 A 3/1979 Chen et al.
4,148,669 A 4/1979 Tanner et al.
4,152,144 A 5/1979 Hasegawa et al.
4,163,071 A 7/1979 Weatherly et al.
4,260,416 A 4/1981 Kavesh et al.
4,268,564 A 5/1981 Narasimhan
4,289,009 A 9/1981 Festag et al.
4,309,587 A 1/1982 Nakano et al.
4,321,289 A 3/1982 Bartsch
4,330,027 A 5/1982 Narasimhan
4,373,128 A 2/1983 Asai et al.
4,374,900 A 3/1983 Hara et al.
4,381,943 A 5/1983 Dickson et al.
4,385,932 A 5/1983 Inomata et al.
4,385,944 A 5/1983 Hasegawa
4,396,820 A 8/1983 Puschner
4,409,296 A 10/1983 Ward
4,472,955 A 9/1984 Nakamura et al.
4,482,612 A 11/1984 Kuroki et al.
4,487,630 A 12/1984 Crook et al.
4,488,882 A 12/1984 Dausinger et al.
4,499,158 A 2/1985 Onuma et al.
4,515,870 A 5/1985 Bose et al.
4,523,625 A 6/1985 Ast
4,526,618 A 7/1985 Keshavan et al.
4,557,981 A 12/1985 Bergmann
4,564,396 A 1/1986 Johnson et al.
4,570,568 A 2/1986 Fair
4,582,536 A 4/1986 Raybould
4,585,617 A 4/1986 Tenhover et al.
4,612,059 A 9/1986 Mori et al.
4,621,031 A 11/1986 Scruggs
4,623,387 A 11/1986 Masumoto et al.
4,648,609 A 3/1987 Deike
4,656,099 A 4/1987 Sievers
4,668,310 A 5/1987 Kudo et al.
4,707,581 A 11/1987 Blaskovits et al.
4,710,235 A 12/1987 Scruggs
4,721,154 A 1/1988 Christ et al.
4,725,512 A 2/1988 Scruggs
4,728,580 A 3/1988 Grasselli et al.
4,731,253 A 3/1988 DuBois
4,741,974 A 5/1988 Longo et al.
4,743,513 A 5/1988 Scruggs
4,770,701 A 9/1988 Henderson et al.
4,781,803 A 11/1988 Harris et al.
4,810,850 A 3/1989 Tenkula et al.
4,850,524 A 7/1989 Schick
4,854,370 A 8/1989 Nakamura
4,892,628 A 1/1990 Guilinger
4,900,638 A 2/1990 Emmerich
4,960,643 A 10/1990 Lemelson
4,968,363 A 11/1990 Hashimoto et al.
4,976,417 A 12/1990 Smith
4,987,033 A 1/1991 Abkowitz et al.
4,990,198 A 2/1991 Masumoto et al.
5,030,519 A 7/1991 Scruggs et al.
5,032,196 A 7/1991 Masumoto et al.
5,053,084 A 10/1991 Masumoto et al.
5,053,085 A 10/1991 Masumoto et al.
5,074,935 A 12/1991 Masumoto et al.
5,112,388 A 5/1992 Schulz et al.
5,117,894 A 6/1992 Katahira
5,127,969 A 7/1992 Sekhar
5,131,279 A 7/1992 Lang et al.
5,169,282 A 12/1992 Ueda et al.
5,189,252 A 2/1993 Huffman et al.
5,213,148 A 5/1993 Masumoto et al.
5,225,004 A 7/1993 O'Handley et al.
5,250,124 A 10/1993 Yamaguchi et al.
5,279,349 A 1/1994 Horimura
5,288,344 A 2/1994 Peker et al.
5,294,462 A 3/1994 Kaiser et al.
5,296,059 A 3/1994 Masumoto et al.
5,306,463 A 4/1994 Horimura
5,312,495 A 5/1994 Masumoto et al.
5,324,368 A 6/1994 Masumoto et al.
5,338,376 A 8/1994 Liu et al.
5,368,659 A 11/1994 Peker et al.
5,380,349 A 1/1995 Taniguchi et al.
5,380,375 A 1/1995 Hashimoto et al.
5,384,203 A 1/1995 Apfel
5,390,724 A 2/1995 Yamauchi et al.
5,429,725 A 7/1995 Thorpe et al.
5,440,995 A 8/1995 Levitt
5,449,425 A 9/1995 Renard et al.
5,482,577 A 1/1996 Hashimoto et al.
5,482,580 A 1/1996 Scruggs et al.
5,567,251 A 10/1996 Peker et al.
5,567,532 A 10/1996 Peker et al.
5,589,012 A 12/1996 Hobby et al.
5,593,514 A 1/1997 Giessen et al.
5,618,359 A 4/1997 Lin et al.
5,634,989 A 6/1997 Hashimoto et al.
5,711,363 A 1/1998 Scruggs et al.
5,735,975 A 4/1998 Lin et al.
5,797,443 A 8/1998 Lin et al.
5,807,468 A 9/1998 Sakamoto et al.
5,886,254 A 3/1999 Chi
5,950,704 A 9/1999 Johnson et al.
5,961,745 A 10/1999 Inoue et al.
6,004,661 A 12/1999 Sakai et al.
6,010,580 A 1/2000 Dandliker et al.
6,021,840 A 2/2000 Colvin
6,027,586 A 2/2000 Masumoto et al.
6,039,860 A 3/2000 Cooper et al.
6,044,893 A 4/2000 Taniguchi et al.
6,053,989 A 4/2000 Orillion et al.
6,077,367 A 6/2000 Mizushima et al.
6,183,889 B1 2/2001 Koshiba et al.
6,200,685 B1 3/2001 Davidson
6,218,029 B1 4/2001 Rickerby
6,258,183 B1 7/2001 Onuki et al.
6,261,386 B1 7/2001 Perepezko et al.
6,303,015 B1 10/2001 Thorpe et al.
6,306,228 B1 10/2001 Inoue et al.
6,325,868 B1 12/2001 Kim et al.
6,326,295 B1 12/2001 Figura
6,371,195 B1 4/2002 Onuki et al.
6,376,091 B1 4/2002 Croopnick
6,408,734 B1 6/2002 Cohen
6,446,558 B1 9/2002 Peker et al.
6,620,264 B2 9/2003 Kundig et al.
6,623,566 B1 9/2003 Senkov et al.
6,638,369 B1 10/2003 Tucker et al.
6,689,234 B2 2/2004 Branagan
6,695,936 B2 2/2004 Johnson
6,749,698 B2 6/2004 Shimizu et al.
7,008,490 B2 3/2006 Peker
7,141,127 B2 11/2006 Yoshizawa
7,282,103 B2 10/2007 Sakamoto et al.
7,582,172 B2 9/2009 Schroers et al.
7,622,011 B2 11/2009 Inoue et al.
7,918,011 B2 4/2011 Boylan et al.
7,918,946 B2 4/2011 Sato

(56) References Cited

U.S. PATENT DOCUMENTS

| | | | |
|---|---|---|---|
| 8,052,923 | B2 | 11/2011 | Langlet |
| 8,287,664 | B2 | 10/2012 | Brunner |
| 8,529,712 | B2 | 9/2013 | Demetriou et al. |
| 8,911,572 | B2 | 12/2014 | Kim et al. |
| 9,085,814 | B2 | 7/2015 | Na et al. |
| 9,359,664 | B2 | 6/2016 | Demetriou et al. |
| 9,365,916 | B2 | 6/2016 | Floyd et al. |
| 9,534,283 | B2 | 1/2017 | Na et al. |
| 9,556,504 | B2 | 1/2017 | Na et al. |
| 9,862,024 | B2 | 1/2018 | Tomita et al. |
| 9,920,400 | B2 | 3/2018 | Na et al. |
| 9,920,410 | B2 | 3/2018 | Na et al. |
| 9,957,596 | B2 | 5/2018 | Na et al. |
| 10,000,834 | B2 | 6/2018 | Na et al. |
| 10,287,663 | B2 | 5/2019 | Na et al. |
| 2002/0036034 | A1 | 3/2002 | Xing et al. |
| 2004/0140016 | A1 | 7/2004 | Sakamoto et al. |
| 2005/0263216 | A1 | 12/2005 | Chin et al. |
| 2006/0037361 | A1 | 2/2006 | Johnson et al. |
| 2006/0213586 | A1 | 9/2006 | Kui |
| 2006/0231169 | A1 | 10/2006 | Park et al. |
| 2006/0254386 | A1 | 11/2006 | Inoue et al. |
| 2007/0003812 | A1 | 1/2007 | Wende |
| 2007/0048164 | A1 | 3/2007 | Demetriou et al. |
| 2007/0079907 | A1 | 4/2007 | Johnson et al. |
| 2007/0175545 | A1 | 8/2007 | Urata et al. |
| 2009/0014096 | A1 | 1/2009 | Wiest et al. |
| 2009/0101244 | A1 | 4/2009 | Ogawa et al. |
| 2009/0110955 | A1 | 4/2009 | Hartmann et al. |
| 2009/0114317 | A1 | 5/2009 | Collier et al. |
| 2010/0089761 | A1 | 4/2010 | Wang et al. |
| 2010/0096045 | A1 | 4/2010 | Sato |
| 2010/0300148 | A1* | 12/2010 | Demetriou ..... C22C 45/008 63/12 |
| 2012/0073710 | A1 | 3/2012 | Kim et al. |
| 2012/0168037 | A1 | 7/2012 | Demetriou et al. |
| 2013/0048152 | A1 | 2/2013 | Na et al. |
| 2013/0263973 | A1 | 10/2013 | Kurahashi et al. |
| 2014/0007991 | A1 | 1/2014 | Demetriou et al. |
| 2014/0076467 | A1 | 3/2014 | Na et al. |
| 2014/0096873 | A1 | 4/2014 | Na et al. |
| 2014/0116579 | A1 | 5/2014 | Na et al. |
| 2014/0130942 | A1 | 5/2014 | Floyd et al. |
| 2014/0130945 | A1 | 5/2014 | Na et al. |
| 2014/0190593 | A1 | 7/2014 | Na et al. |
| 2014/0213384 | A1 | 7/2014 | Johnson et al. |
| 2014/0238551 | A1 | 8/2014 | Na et al. |
| 2014/0345755 | A9 | 11/2014 | Na et al. |
| 2015/0047755 | A1 | 2/2015 | Na et al. |
| 2015/0096652 | A9 | 4/2015 | Na et al. |
| 2015/0158126 | A1 | 6/2015 | Hartmann et al. |
| 2015/0159242 | A1 | 6/2015 | Na et al. |
| 2015/0176111 | A1 | 6/2015 | Na et al. |
| 2015/0197837 | A9 | 7/2015 | Schramm et al. |
| 2015/0240336 | A1 | 8/2015 | Na et al. |
| 2016/0047023 | A1 | 2/2016 | Na et al. |
| 2016/0060739 | A1 | 3/2016 | Na et al. |
| 2016/0090644 | A1 | 3/2016 | Na et al. |
| 2017/0152587 | A9 | 6/2017 | Na et al. |
| 2017/0152588 | A9 | 6/2017 | Na et al. |
| 2018/0312949 | A1 | 11/2018 | Na et al. |

FOREIGN PATENT DOCUMENTS

| | | | |
|---|---|---|---|
| CN | 1354274 | A | 6/2002 |
| CN | 1442866 | A | 9/2003 |
| CN | 1653200 | A | 8/2005 |
| CN | 101289718 | A | 10/2008 |
| CN | 102459680 | A | 5/2012 |
| CN | 103917673 | A | 7/2014 |
| DE | 3929222 | A1 | 3/1991 |
| DE | 10237992 | A1 | 3/2003 |
| DE | 102011001783 | A1 | 10/2012 |
| DE | 102011001784 | A1 | 10/2012 |
| EP | 0014335 | A1 | 8/1980 |
| EP | 0161363 | A2 | 11/1985 |
| EP | 0161393 | A1 | 11/1985 |
| EP | 0164200 | A1 | 12/1985 |
| EP | 0260706 | A1 | 3/1988 |
| EP | 0747498 | A1 | 12/1996 |
| EP | 1077272 | A1 | 2/2001 |
| EP | 1108796 | A1 | 6/2001 |
| EP | 1522602 | A1 | 4/2005 |
| EP | 2432909 | A2 | 3/2012 |
| EP | 2748345 | B1 | 8/2018 |
| GB | 2005302 | A | 4/1979 |
| GB | 2106145 | A | 2/1987 |
| GB | 2236325 | A | 4/1991 |
| HK | 1168875 | A | 1/2013 |
| IN | 337634 | | 5/2020 |
| JP | S5476423 | A | 6/1979 |
| JP | 55141537 | A | 11/1980 |
| JP | S55148752 | A | 11/1980 |
| JP | 56112449 | | 9/1981 |
| JP | S5713146 | | 1/1982 |
| JP | 60024346 | A | 2/1985 |
| JP | 61238423 | A | 10/1986 |
| JP | 63079930 | A | 4/1988 |
| JP | 63079931 | A | 4/1988 |
| JP | S63277734 | A | 11/1988 |
| JP | H01205062 | A | 8/1989 |
| JP | 06-264200 | | 9/1994 |
| JP | 08269647 | | 10/1996 |
| JP | 2008333660 | A | 12/1996 |
| JP | H09143642 | A | 6/1997 |
| JP | 11071657 | A | 3/1999 |
| JP | H1171659 | A | 3/1999 |
| JP | 2011293427 | | 10/1999 |
| JP | 2000-256811 | | 9/2000 |
| JP | 2001049407 | A | 2/2001 |
| JP | 2001338808 | A | 12/2001 |
| JP | 2000237902 | | 2/2002 |
| JP | 2002069549 | A | 3/2002 |
| JP | 2002275605 | A | 9/2002 |
| JP | 2005264260 | | 9/2005 |
| JP | 2007075867 | A | 3/2007 |
| JP | 2014132116 | A | 7/2014 |
| JP | 2014529013 | A | 10/2014 |
| JP | 6178073 | B2 | 7/2017 |
| KR | 100582579 | B1 | 5/2006 |
| KR | 1020090038016 | A | 4/2009 |
| WO | 199902748 | A1 | 1/1999 |
| WO | 200068469 | A2 | 11/2000 |
| WO | 2003040422 | A1 | 5/2003 |
| WO | 2004059019 | A1 | 7/2004 |
| WO | 2010135415 | A2 | 11/2010 |
| WO | 2010135415 | A3 | 3/2011 |
| WO | 2012047651 | A2 | 4/2012 |
| WO | 2012047651 | A3 | 4/2012 |
| WO | 2012053570 | A1 | 4/2012 |
| WO | 2013028790 | A2 | 2/2013 |
| WO | 2013028790 | A3 | 6/2013 |
| WO | 2014043722 | A2 | 3/2014 |
| WO | 2014058893 | A1 | 4/2014 |
| WO | 2014078697 | A2 | 5/2014 |
| WO | 2014078697 | A3 | 5/2015 |

OTHER PUBLICATIONS

Extended European Search Report for European Application No. 10778319.3, Search completed Feb. 20, 2017, dated Feb. 27, 2017, 16 Pgs.

Extended European Search Report for European Application No. 11831296.6, Search completed Apr. 24, 2017, dated May 3, 2017, 11 Pgs.

International Preliminary Report on Patentability for Application PCT/US2013/070370, Report dated May 19, 2015, dated May 28, 2015, 09 pgs.

International Preliminary Report on Patentability for International Application No. PCT/US10/35382, Report dated Nov. 22, 2011, dated Dec. 1, 2011, 5 Pgs.

(56) References Cited

OTHER PUBLICATIONS

International Preliminary Report on Patentability for International Application No. PCT/US2012/051921, Report dated Feb. 25, 2014, dated Mar. 6, 2014, 8 Pgs.
International Preliminary Report on Patentability for International Application No. PCT/US2013/060226, dated Mar. 17, 2015, dated Mar. 26, 2015, 9 Pgs.
International Preliminary Report on Patentability for International Application No. PCT/US2013/063902, Report dated Apr. 8, 2015, dated Apr. 16, 2015, 12 Pgs.
International Search Report and Written Opinion for Application PCT/US2013/070370, search completed on Mar. 30, 2015, dated Apr. 13, 2015, 12 pgs.
International Search Report and Written Opinion for International Application No. PCT/US2010/035382, completed Dec. 27, 2010, dated Dec. 29, 2010, 7 pgs.
International Search Report and Written Opinion for International Application PCT/US2013/060226, Search completed Dec. 5, 2013, dated Jun. 11, 2014, 14 Pgs.
International Search Report and Written Opinion for International Application No. PCT/US2013/063902, Search completed Nov. 29, 2013, dated Feb. 14, 2014, 18 Pgs.
International Search Report and Written Opinion for International Application PCT/US2012/051921, dated Apr. 16, 2013, 14 pgs.
International Search Report and Written Opinion for International Application PCT/US2013/067519, report completed Dec. 6, 2013, dated Dec. 18, 2013, 13 Pgs.
International Search Report for International Application PCT/US2005/045955 filed Dec. 16, 2005, completed Jun. 29, 2006, dated Aug. 18, 2006, 3 pgs.
UES, Inc. Software Products Center, "ProCAST . . . not just for castings!", Sep. 30, 1996, 1 pg.
Kimura et al., "Fracture Toughness of Amorphous Metals", Scripta Metallurgy, 1975, vol. 9, pp. 211-222.
Koch et al., "Preparation of "Amorphous" Ni60Nb40 by Mechanical Alloying", Appl. Phys. Lett., Dec. 1, 1983, vol. 43, No. 11, pp. 1017-1019.
Laws et al., "Electron-band theory inspired design of magnesium—precious metal bulk metallic glasses with high thermal stability and extended ductility", Scientific Reports, Jun. 13, 2017, vol. 7, No. 3400, 11 pgs, doi: 10.1038/s41598-017-03643-7.
Lewandowski et al., "Tough Fe•based bulk metallic glasses", Applied Physics Letters, vol. 92, pp. 091918-1-091918-3, published online Mar. 7, 2008, http://dx.doi.org/10.1063/1.2890489.
Li et al., "Effects of Cu, Fe, and Cu Addition on the Glass Forming Ability and Mechanical Properties of Zr—Al—Ni Bulk Metallic Glasses", Science China, Physics, Mechanics & Astronomy, Dec. 2012, vol. 55, No. 12, pp. 2367-2371.
Li et al., "Excellent soft-magnetic properties of (Fe,Co)—Mo—(P,C,B,Si) bulk glassy alloys with ductile deformation behavior", Applied Physics Letters, 2007), vol. 91, pp. 234101-1-234101-3, https://doi.org/10.1063/1.2820608.
Liu et al., "Ductile Fa-Based BMGs with High Glass Forming Ability and High Strength", Materials Transactions, Jan. 28, 2008, vol. 49, No. 2, pp. 231-234, http://doi.org/10.2320/matertrans.MRA2007186.
Lu et al., "Structural Amorphous Steels", Physical Review Letters, Jun. 18, 2004, vol. 92, No. 24, pp. 244503-1-245503-4, DOI: 10.1103/PhysRevLett.92.245503.
Makino et al., "Fe-Metalloid Metallic Glasses with High Magnetic Flux Density and High Glass-Forming Ability", Materials Science Forum 2007, vols. 561-565, pp. 1361-1366.
Maret et al., "Structural Study of $Be_{43}Hf_xZr_{57-x}$ Metallic Glasses by X-Ray and Neutron Diffraction", J. Physique, 1986, vol. 47, pp. 863-871.
Masumoto, "Recent Progress in Amorphous Metallic Materials in Japan", Materials Science and Engineering, 1994, vol. A179/A180, pp. 8-16.
Masumoto et al., "Tensile Properties of Iron-base Amorphous Alloy (Fe—P—C) Quenched from Liquid", Science Reports of the Research Institutes, Tohoku University, 1974, vol. 6, pp. 200-215.
Mitsuhashi et al., "The corrosion behavior of amorphous nickel base alloys in a hot concentrated phosphoric acid", Corrosion Science, 1987, vol. 27, No. 9, pp. 957-970.
Morrison et al., "Cyclic-anodic-polarization studies of a $Zr_{41.2}Ti_{13.8}Ni_{10}Cu_{12.5}Be_{22.5}$ bulk metallic glass", Intermetallics, 2004, vol. 12, pp. 1177-1181.
Murakami, "Stress Intensity Factors Handbook", Oxford: Pergamon Press, 1987, vol. 2, 4 pages.
Murakami, "Stress Intensity Factors Handbook", vol. 2. Oxford (United Kingdom): Pergamon Press; 1987, 11 pgs.
Nouri et al., "Chemistry (intrinsic) and inclusion (extrinsic) effects on the toughness and Weibull modulus of Fe•based bulk metallic", Philosophical Magazine Letters, Nov. 2008, vol. 88, No. 11, pp. 853•861, DOI:10.1080/09500830802438131.
Park et al., "Development of new Ni-based amorphous alloys containing no metalloid that have large undercooled liquid regions", Scripta Materialia, 2000, vol. 43, No. 2, pp. 109-114.
Peker et al., "A highly processible metallic glass: $Zr_{41.2}Ti1_{3.8}Cu_{12.5}Ni_{10.0}Be_{22.5}$", Applied Physics Letters, Oct. 25, 1993, vol. 63, No. 17, pp. 2342-2344.
Polk et al, "The Effect of Oxygen Additions on the Properties of Amorphous Transition Metal Alloys", source and date unknown, pp. 220-230.
Ponnambalam et al., "Fe-Based Bulk Metallic Glasses with Diameter Thickness Larger Than One Centimeter", J Mater Res, Feb. 17, 2004. vol. 19; pp. 1320-1323, DOI: 10.1557/JMR.2004.0176.
Ponnambalam et al., "Fe—Mn—Cr—Mo—(Y,Ln)—C-8 (Ln= Lanthanides) bulk metallic glasses as formable amorphous steel alloys", Journal of Materials Research, Oct. 2004, vol. 19, No. 10, pp. 3046-3052, DOI:10.1557/JMR.2004.0374.
Rabinkin et al., "Brazing Stainless Steel Using New MBF-Series of Ni—Cr—B—Si Amorphous Brazing Foils New Brazing Alloys Withstand High-Temperature and Corrosive Environments", Welding Research Supplement, Feb. 1998, pp. 66-75.
Roshenow, "Heat Transfer", Handbook of Engineering, 1936, Section 12, pp. 1113-1119.
Schroers, "The Superplastic Forming of Bulk Metallic Glasses", JOM, May 2005, pp. 35-39.
Shamlaye et al., "Exceptionally broad bulk metallic glass formation in the Mg—Cu—Yb system", Acta Materialia, Apr. 15, 2017, vol. 128, pp. 188-196, doi: 10.1016/j.actamat.2017.02.013.
Shen et al., "Bulk ferromagnetic glasses prepared by flux melting and water", Applied Physics Letters, Jul. 5, 1999, vol. 75, No. 1, pp. 49-51, published online Jun. 29, 1999, doi.org/10.1063/1.124273.
Shen et al., "Excellent soft-ferromagnetic bulk glassy alloys with high saturation magnetization", Applied Physics Letters, 2006, vol. 88, pp. 131907-1-131907-3, published online Mar. 28, 2006, DOI:10.1063/1.2189910.
Suh, Jin-Yoo, "Fracture Toughness Study on Bulk Metallic Glasses and Novel Joining Method Using Bulk Metallic Glass Solder", Thesis, California Institute of Technology, 2009, 48 pgs.
Sunderman, "Potential toxicity from nickel contamination of intravenous fluids", Annals of Clinical & Laboratory Science, 1983, vol. 13, pp. 1-4.
Tanner et al., "Metallic Glass Formation and Properties in Zr and Ti Alloyed with Be—I The Binary Zr—Be and Ti—Be Systems", Acta Metallurgica, 1979, vol. 27, pp. 1727-1747.
Tanner, et al., "Physical Properties of $Ti_{50}Be_{40}Zr_{10}$ Glass", Scripta Metallurgica, 1977, vol. 11, pp. 783-789.
Tanner, L.C., "The Stable and Metastable Phase Relations in the Hf—Be Alloy System", Metallurgica, vol. 28, 1980, pp. 1805-1815.
Tanner, L.E, "Physical Properties of Ti—Be—Si Glass Ribbons", Scripta Metallurgica, 1978, vol. 12, pp. 703-708.
Wang et al., "Bulk Amorphous $Ni_{75-x}Nb_5MxP_{20}$-yBy(M= Cr,Mo)Alloys with Large Supercooling and High Strength", Materials Transactions, JIM, 1999, vol. 40, No. 10, pp. 1130-1136.
Wang et al., "Fatigue behavior and fracture morphology of Zr50Al10Cu40 and $Zr_{50}Al_{10}Cu_{30}Ni_{10}$ bulk-metallic glasses", Intermetallics, 2004, vol. 12, pp. 1219-1227.

(56) References Cited

OTHER PUBLICATIONS

Wesseling et al., "Preliminary assessment of flow, notch toughness, and high temperature behavior of $Cu_{60}Zr_{20}Hf_{10}Ti_{10}$ bulk metallic glass", Scripta Materialia, Jul. 2004, vol. 51, pp. 151-154, doi:10.1016/j.scriptamat.2004.03.034.
Xi et al., "Fracture of Brittle Metallic Glasses: Brittleness or Plasticity", Physical Review Letters, Apr. 1, 2005, vol. 94, pp. 125510-1-125510-4, doi: 10.1103/PhysRevLett.94.125510.
Yamamoto et al., "Cytotoxicity evaluation of 43 metal salts using murine fibroblasts and osteoblastic cells", Journal of Biomed. Materials Research, 1998, vol. 39, 331-340.
Yokoyama et al., "Hot-press workability of Ni-based glassy alloys in supercooled liquid state and production of the glassy alloy separators for proton exchange membrane fuel cell", Journal of the Japan Society of Powder and Powder Metallurgy, 2007, vol. 54, No. 11, pp. 773-777.
Yokoyama et al., "Viscous Flow Workability of Ni—Cr—P—B Metallic Glasses Produced by Melt-Spinning in Air", Materials Transactions, Nov. 2007 vol. 48, No. 12, pp. 3176-3180.
Zhang et al., "Amorphous Zr—A1—TM (TM=Co, Ni, Cu) Alloys with Significant Supercooled Liquid Region of Over 100K", Materials Transactions, JIM, 1991, vol. 32, No. 11, pp. 1005-1010.
Zhang et al., "Ductile Fe-Based Bulk MetallicGlass with Good Soft-Magnetic Properties", Materials Transactions, 2007, vol. 48, No. 5, pp. 1157-1160, doi:10.2320/matertrans.48.1157.
Zhang et al., "The corrosion behavior of amorphous Ni—Cr—P alloys in concentrated hydrofluoric acid", Corrosion Science, Oct. 1992, vol. 33, No. 10, pp. 1519-1528.
Written Opinion for International Application No. PCT/US2005/045955 filed Dec. 16, 2005, completed Jun. 29, 2006, dated Aug. 18, 2006, 5 pgs.
Abrosimova et al., "Phase segregation and crystallization in the amorphous alloy Ni70Mo10P20", Physics of the Solid State, 1998, vol. 40., No. 9, pp. 1429-1432.
American Society for Metals, "Forging and Casting", Metals Handbook, Jan. 1970, vol. 5, 8th Edition, 16 pgs.
ASM Committee on Tooling, Materials "Superhard Tool Materials", Metals Handbook, Ninth Edition, vol. 3, Properties and Selection: Stainless Steels, Tool Materials and Special Purpose Metals, American Society for Metals, 1980, pp. 448-465, title page and copyright page.
Author Unknown, "A World of Superabrasives Experience at Your Service", source unknown, 4 pgs.
Author Unknown, "GE Superabrasives—Micron Powders", source unknown, 1 pg.
Author Unknown, "GE Superabrasives—The MBS—900 Series Product Line", source unknown, 2 pgs.
Author Unknown, "GE Superabrasives—The MBS 700 Series Product Line", source unknown, 2 pgs.
Author Unknown, "GE Superabrasives—The Metal Bond System", source unknown, 1 pg.
Author Unknown, "GE Superabrasives—The Resin Bond System", source unknown, 1 pg.
Author Unknown, "Standard Practice for Conducting Dry Sand/Rubber Wheel Abrasion Tests", ASTM Designation: G 65-81, pp. 351-368.
Burke, "The Corrosion of Metals in Tissues; and an Introduction to Tantalum", The Canadian Medical Association Journal, Aug. 1940, pp. 125-128.
Chen et al., "Transient liquid-phase bonding of T91 steel pipes using amorphous foil", Materials Science and Engineering, 2009, A, vol. 499, No. 1-2, pp. 114-117, doi:10.1016/jmsea.2007.11.133.
Debold et al., "How to Passivate Stainless Steel Parts", Modern Machine Shop, article posted Oct. 1, 2003, 10 pgs.
Demetriou et al., "Glassy steel optimized for glass-forming ability and toughness", Applied Physics Letters, Jul. 31, 2009, vol. 95; pp. 041907-1-041907-3; http:/idx.doi.org/10.1063/1.3184792.
Duan et al., "Thermal and elastic properties of Cu—Zr—Be bulk metallic glass forming alloys", Applied Physics Letters, 2007, vol. 90, pp. 211901-1-211901-3, doi: 10.1063/1.2741050.
Duwez et al., "Amorphous Ferromagnetic Phase in Iron-Carbon Phosphorus Alloys", Journal of Applied Physics, vol. 38, No. 10, pp. 4096•4097, ISSN 0021•8979, http:// dx.doi.org/10.1063/1.1709084.
Geurtsen, "Biocompatibility of Dental Casting Alloys", Crit. Rev. Oral Biol. Med., 2002, vol. 13, No. 1, pp. 71-84.
Greer et al., "Bulk Metallic Glasses: At the Cutting Edge of Metals Research", MRS Bulletin, Aug. 2007, vol. 32, pp. 611-619.
Gu et al., "Ductility improvement of amorphous steels : Roles of shear modulus and electronic structure", Acta Materialia, Jan. 2008, vol. 56, Issue 1, pp. 88-94, available online Oct. 24, 2007, doi:10.1016/j.actamat.2007.09.011.
Gu et al., "Effects of carbon content on the mechanical properties of amorphous steel alloys", Scripta Materialia, vol. 57, Issue 4, Aug. 2007, pp. 289-292, doi:10.1016/j.scriptamat.2007.05.006.
Gu et al., "Mechanical properties of iron-based bulk metallic glasses", Journal of Materials Research, vol. 22, Issue 2, Feb. 2007, pp. 344-351, doi.org/10.1557/jmr.2007.0036.
Guo et al., "Enhancement of plasticity of Fe-based bulk metallic glass by Ni substitution for Fe", Journal of Alloys and Compounds, Feb. 18, 2010, vol. 504, pp. S78-S81, doi:10.1016/j.jallcom.2010.02.058.
Habazaki et al., "Preparation of corrosion-resistant amorphous Ni—Cr—P—B bulk alloys containing molybdenum and tantalum", Material Science and Engineering, 2001, vol. A304-306, pp. 696-700.
Hartmann et al., "New Amorphous Brazing Foils for Exhaust Gas Application", Proceedings of the 4th International Brazing and Soldering Conference, Apr. 26-29, 2009, Orlando, Florida, USA, 9 pgs.
Hasegawa et al., "Superconducting Properties of Be—Zr Glassy Alloys Obtained by Liquid Quenching", May 9, 1977, pp. 3925-3928.
Hess et al., "Indentation fracture toughness of amorphous steel", Journal of Materials Research, Apr. 2005, vol. 20, Issue 4, pp. 783-786, DOI:10.1557/JMR.2005.0104.
Hiromoto et al., "Effect of chloride ion on the anodic polarization behavior of the $Zr_{65}Al_{7.5}Ni_{10}Cu_{17.5}$ amorphous alloy in phosphate buffered solution", Corrosion Science, 2000, vol. 42, pp. 1651-1660.
Hiromoto et al., "Effect of pH on the polarization behavior of $Zr_{65}Al_{7.5}Ni_{10}Cu_{17.5}$ amorphous alloy in a phosphate-buffered solution", Corrosion Science, 2000, vol. 42, pp. 2193-2200.
Inoue, "Stabilization of Metallic Supercooled Liquid and Bulk Amorphous Alloys", Acta Materialia, 2000, vol. 48, pp. 279-306.
Inoue et al., "Bulky La—A1—TM (TM=Transition Metal) Amorphous Alloys with High Tensile Strength Produced by a High-Pressure Die Casting Method", Materials Transactions, JIM, vol. 34, No. 4, 1993, pp. 351-358.
Inoue et al., "Mg—Cu—Y Bulk Amorphous Alloys with High Tensile Strength Produced by High-Pressure Die Casting Method", Materials Transactions, JIM, 1992, vol. 33, No. 10, pp. 937-945.
Inoue et al., "Preparation of Bulky Amorphous Zr—Al—Co—Ni—Cu Alloys by Copper Mold Casting and Their Thermal and Mechanical Properties", Materials Transactions, JIM, 1995, vol. 36, No. 3, pp. 391-398.
Inoue et al., "Production of Fe—P—C amorphous wires by in-rotating-water spinning method and mechanical properties of the wires", Journal of Materials Science, Feb. 1982, vol. 17, Issue 2, pp. 580-588, doi:10.1007/BF00591492.
Inoue et al., "Zr—A1—Ni Amorphous Alloys with High Glass Transition Temperature and Significant Supercooled Liquid Region", Materials Transactions, JIM, 1990, vol. 31, No. 3, pp. 177-183.
Johnson, "Bulk Glass-Forming Metallic Alloys: Science and Technology", MRS Bulletin, Oct. 1999, pp. 42-56.
Johnson et al., "A Universal Criterion for Plastic Yielding of Metallic Glasses with a (T/Tg)2/3 Temperature Dependence", Physical Review Letters, Nov. 4, 2005, vol. 95, Issue 19, pp. 195501-195501-4, DOI: 10.1103/PhysRevLett.95.195501.
Jost et al., "The Structure of Amorphous Be—Ti—Zr Alloys", Zeitschrift fur Physikalische Chemie Neue Folge, Bd. 157, 1988, pp. 11-15.

(56) References Cited

OTHER PUBLICATIONS

Katagiri et al., "An attempt at preparation of corrosion-resistant bulk amorphous Ni—Cr—Ta—Mo—P—B alloys", Corrosion Science, Jan. 2001, vol. 43, No. 1,pp. 183-191, doi: 10.1016/S0010-938X(00)00068-8.
Kato et al., "Production of Bulk Amorphous Mg85Y10Cu5 Alloy by Extrusion of Atomized Amorphous Powder", Materials Transactions, JIM, vol. 35, No. 2, 1994, pp. 125-129.
Kawamura et al., "Full Strength Compacts by Extrusion of Glassy Metal Powder at the Supercooled Liquid State", American Institute of Physics, May 30, 1995, vol. 67, No. 14, pp. 2008-2010.
Kawashima et al., "Change in corrosion behavior of amorphous Ni—P alloys by alloying with chromium, molybdenum or tungsten", Journal of Non-Crystalline Solids, 1985, vol. 70, No. 1, pp. 69-83.

* cited by examiner

TOUGH IRON-BASED GLASSES WITH HIGH GLASS FORMING ABILITY AND HIGH THERMAL STABILITY

CROSS-REFERENCE TO RELATED APPLICATIONS

The present application claims priority under 35 U.S.C. 119(e) to U.S. Provisional Application No. 62/805,845, entitled "Tough Iron-Based Glasses with High Glass Forming Ability and High Thermal Stability" to Na et al., filed Feb. 14, 2019, the disclosure of which is incorporated herein by reference in its entirety.

FIELD

The disclosure is directed to Fe—Cr—Mo—Ni—P—C—B metallic glasses having a high glass forming ability and a high thermal stability of the supercooled liquid against crystallization.

BACKGROUND

U.S. Pat. Nos. 8,529,712 and 8,911,572 entitled "Tough Iron-Based Bulk Metallic Glass Alloys," the disclosures of which is incorporated herein by reference in their entirety, disclose Fe-based glass forming alloys comprising at least P, C, and B demonstrating a critical rod diameter of at least 2 mm and a shear modulus of less than 60 GPa, where the Fe atomic concentration is at least 60 percent, the P atomic concentration varies in the range of 5 to 17.5 percent, the C atomic concentration varies in the range of 3 to 6.5 percent, and the B atomic concentration varies in the range of 1 to 3.5 percent. The patents also disclose that the Fe-based alloys may optionally comprise Mo in an atomic concentration varying in the range of 2 to 8 percent, Cr in an atomic concentration varying in the range of 1 to 7 percent, and Ni in an atomic concentration varying in the range of 3 to 7 percent. The patents present several examples of amorphous Fe—P—C—B alloys that comprise Mo, Cr, and Ni demonstrating a critical rod diameter of up to 6 mm and a thermal stability of the supercooled liquid (i.e. a difference between the crystallization and glass transition temperatures at a heating rate of 20 K/min) of under 40° C.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

BRIEF SUMMARY

Figure 1:
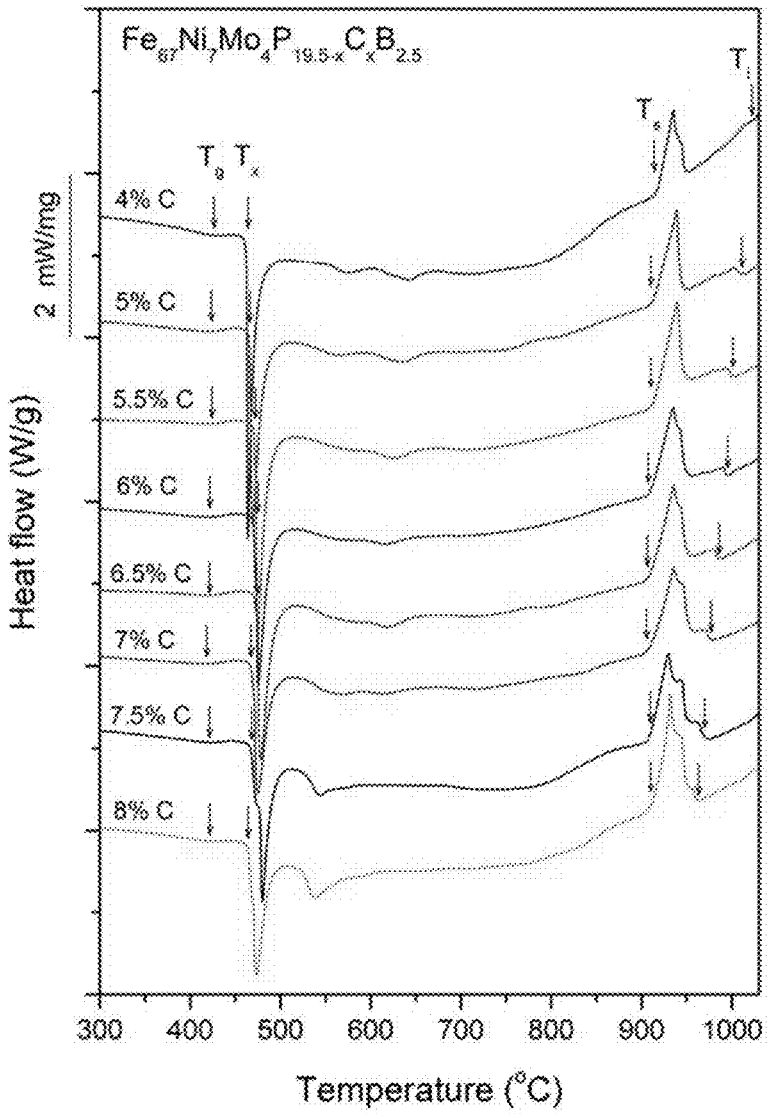
FIG. 1 provides calorimetry scans for sample metallic glasses according to $Fe_{67}Ni_7Mo_4P_{19.5-x}C_xB_{2.5}$ in accordance with embodiments of the disclosure. The glass transition temperature $T_g$ and crystallization temperature $T_x$ are indicated by arrows.

The disclosure provides Fe—Cr—Ni—Mo—P—C—B metallic glass-forming alloys and metallic glasses that have a high glass forming ability along with a high thermal stability of the supercooled liquid against crystallization.

In one embodiment, the disclosure provides a metallic glass-forming alloy or a metallic glass having a composition represented by the following formula (subscripts denote atomic percentages):

$$Fe_{(100-a-b-c-d-e-f)}Cr_aNi_bMo_cP_dC_eB_f \quad \text{EQ. (1)}$$

where:

a is up to 10;

b ranges from 3 to 13;

c ranges from 2 to 7;

d+e+f ranges from 21.25 to 23.75;

e ranges from 4.5 to 8; and f ranges from 1 to 9.

wherein the metallic glass-forming alloy has a critical rod diameter of at least 3 mm, and wherein the thermal stability of the supercooled liquid of the metallic glass against crystallization is at least 45° C.

In another embodiment of the metallic glass-forming alloy or metallic glass, a is up to 9, b ranges from 4 to 12, c ranges from 3 to 6.5, d+e+f ranges from 21.5 to 23.5, e ranges from 5.25 to 7.5, f ranges from 1.5 to 8.5, wherein the metallic glass-forming alloy has a critical rod diameter of at least 4 mm, and wherein the thermal stability of the supercooled liquid of the metallic glass against crystallization is at least 47.5° C.

In another embodiment of the metallic glass-forming alloy or metallic glass, a is up to 8, b ranges from 4.5 to 10, c ranges from 3.5 to 5.5, d+e+f ranges from 21.5 to 23, e ranges from 5.5 to 7, f ranges from 2 to 7.5, wherein the metallic glass-forming alloy has a critical rod diameter of at least 5 mm, and wherein the thermal stability of the supercooled liquid of the metallic glass against crystallization is at least 50° C.

In another embodiment of the metallic glass, a is less than 3.5, and wherein the critical bending diameter of the metallic glass is at least 0.5 mm.

In another embodiment of the metallic glass, a is less than 2.5, and wherein the critical bending diameter of the metallic glass is at least 0.6 mm.

In another embodiment of the metallic glass, a is less than 1.75, and wherein the critical bending diameter of the metallic glass is at least 0.7 mm.

In another embodiment of the metallic glass, a is less than 1.25, and wherein the critical bending diameter of the metallic glass is at least 0.8 mm.

In another embodiment of the metallic glass, c ranges from 2 to less than 6.5, and wherein the critical bending diameter of the metallic glass is at least 0.6 mm.

In another embodiment of the metallic glass, c ranges from 2 to less than 5.5, and wherein the critical bending diameter of the metallic glass is at least 0.7 mm.

In another embodiment of the metallic glass, c ranges from 2 to less than 4.25, and wherein the critical bending diameter of the metallic glass is at least 0.8 mm.

In another embodiment of the metallic glass, d+e+f ranges from 21.25 to less than 23.5, and wherein the critical bending diameter of the metallic glass is at least 0.6 mm.

In another embodiment of the metallic glass, d+e+f ranges from 21.25 to less than 22.75, and wherein the critical bending diameter of the metallic glass is at least 0.7 mm.

In another embodiment of the metallic glass, e ranges from greater than 5.25 to 8, and wherein the critical bending diameter of the metallic glass is at least 0.8 mm.

In another embodiment of the metallic glass, e ranges from greater than 6.75 to 8, and wherein the critical bending diameter of the metallic glass is at least 0.9 mm.

In another embodiment of the metallic glass, f ranges from 1 to less than 5, and wherein the critical bending diameter of the metallic glass is at least 0.5 mm.

In another embodiment of the metallic glass, f ranges from 1 to less than 4.5, and wherein the critical bending diameter of the metallic glass is at least 0.6 mm.

In another embodiment of the metallic glass, f ranges from 1 to less than 3, and wherein the critical bending diameter of the metallic glass is at least 0.7 mm.

In another embodiment of the metallic glass, f ranges from 1 to less than 2.5, and wherein the critical bending diameter of the metallic glass is at least 0.8 mm.

In another embodiment of the metallic glass-forming alloy or metallic glass, a ranges from 1 to 6.

In another embodiment of the metallic glass-forming alloy or metallic glass, a ranges from 1 to 5.

In another embodiment of the metallic glass-forming alloy or metallic glass, a ranges from 1 to 4.

In another embodiment of the metallic glass-forming alloy or metallic glass, a ranges from 1 to 3.

In another embodiment of the metallic glass-forming alloy or metallic glass, a ranges from 1 to 2.

In another embodiment of the metallic glass-forming alloy or metallic glass, b ranges from 4 to 11.

In another embodiment of the metallic glass-forming alloy or metallic glass, b ranges from 5 to 10.

In another embodiment of the metallic glass-forming alloy or metallic glass, b ranges from 6 to 10.

In another embodiment of the metallic glass-forming alloy or metallic glass, b ranges from 7 to 10.

In another embodiment of the metallic glass-forming alloy or metallic glass, b ranges from 8 to 10.

In another embodiment of the metallic glass-forming alloy or metallic glass, c ranges from 2.5 to 6.5.

In another embodiment of the metallic glass-forming alloy or metallic glass, c ranges from 3 to 6.

In another embodiment of the metallic glass-forming alloy or metallic glass, c ranges from 3.5 to 5.5.

In another embodiment of the metallic glass-forming alloy or metallic glass, c ranges from 3.75 to 5.25.

In another embodiment of the metallic glass-forming alloy or metallic glass, c ranges from 3.75 to 5.

In another embodiment of the metallic glass-forming alloy or metallic glass, c ranges from 3.75 to 4.75.

In another embodiment of the metallic glass-forming alloy or metallic glass, d+e+f ranges from 21.25 to 23.5.

In another embodiment of the metallic glass-forming alloy or metallic glass, d+e+f ranges from 21.5 to 23.

In another embodiment of the metallic glass-forming alloy or metallic glass, d+e+f ranges from 21.75 to 22.75.

In another embodiment of the metallic glass-forming alloy or metallic glass, e ranges from 5 to 7.75.

In another embodiment of the metallic glass-forming alloy or metallic glass, e ranges from 5.25 to 7.5.

In another embodiment of the metallic glass-forming alloy or metallic glass, e ranges from 5.25 to 7.25.

In another embodiment of the metallic glass-forming alloy or metallic glass, e ranges from 5.25 to 7.

In another embodiment of the metallic glass-forming alloy or metallic glass, e ranges from 5.25 to 6.75.

In another embodiment of the metallic glass-forming alloy or metallic glass, e ranges from 5.5 to 6.5.

In another embodiment of the metallic glass-forming alloy or metallic glass, f ranges from 2 to 5.

In another embodiment of the metallic glass-forming alloy or metallic glass, f ranges from 2 to 4.

In another embodiment of the metallic glass-forming alloy or metallic glass, f ranges from 2 to 3.

In another embodiment, the metallic glass-forming alloy has a critical rod diameter of at least 4 mm.

In another embodiment, the metallic glass-forming alloy has a critical rod diameter of at least 5 mm.

In another embodiment, the metallic glass-forming alloy has a critical rod diameter of at least 6 mm.

In another embodiment, the metallic glass-forming alloy has a critical rod diameter of at least 7 mm.

In another embodiment, the thermal stability of the supercooled liquid of the metallic glass against crystallization is at least 51° C.

In another embodiment, the thermal stability of the supercooled liquid of the metallic glass against crystallization is at least 52° C.

In another embodiment, the thermal stability of the supercooled liquid of the metallic glass against crystallization is at least 53° C.

In another embodiment, the thermal stability of the supercooled liquid of the metallic glass against crystallization is at least 54° C.

In another embodiment, the thermal stability of the supercooled liquid of the metallic glass against crystallization is at least 55° C.

In another embodiment, the critical bending diameter of the metallic glass is at least 0.5 mm.

In another embodiment, the critical bending diameter of the metallic glass is at least 0.6 mm.

In another embodiment, the critical bending diameter of the metallic glass is at least 0.7 mm.

In another embodiment, the critical bending diameter of the metallic glass is at least 0.8 mm.

In another embodiment, up to 5 atomic percent of Fe is substituted by Co, Ru, Mn, or a combination thereof.

In another embodiment, up to 2 atomic percent of Ni is substituted by Pd, Pt, or a combination thereof.

In another embodiment, up to 1 atomic percent of Mo is substituted by Nb, Ta, V, W, or a combination thereof.

In another embodiment, up to 2 atomic percent of P is substituted by Si.

The disclosure is also directed to a method of forming a metallic glass, or an article made of a metallic glass, from the metallic glass-forming alloy.

The method includes heating and melting an ingot comprising the metallic glass-forming alloy under inert atmosphere to create a molten alloy, and subsequently quenching the molten alloy fast enough to avoid crystallization of the molten alloy.

In one embodiment, prior to quenching the molten alloy is heated to at least 100° C. above the liquidus temperature of the metallic glass-forming alloy.

In another embodiment, prior to quenching the molten alloy is heated to at least 200° C. above the liquidus temperature of the metallic glass-forming alloy.

In yet another embodiment, prior to quenching the molten alloy is heated to at least 1200° C.

In yet another embodiment, prior to quenching the molten alloy is heated to at least 1300° C.

The disclosure is also directed to a method of thermoplastically shaping a metallic glass into an article, including:

heating a sample of the metallic glass to a softening temperature $T_o$ above the glass transition temperature $T_g$, of the metallic glass to create a heated sample;

applying a deformational force to shape the heated sample over a time $t_o$ that is shorter than the time it takes for the metallic glass to crystallize at $T_o$, and cooling the heated sample to a temperature below $T_g$ to form an article.

In one embodiment, $T_o$ is higher than $T_g$ and lower the liquidus temperature of the metallic glass-forming alloy.

In another embodiment, $T_o$ is greater than $T_g$ and lower than T.

In another embodiment, $T_o$ is higher than $T_x$ and lower than the solidus temperature of the metallic glass-forming alloy.

In another embodiment, $T_o$ is in the range of 550 to 850° C.

In another embodiment, $T_o$ is in the range of 575 to 750° C.

In another embodiment, $T_o$ is in the range of 600 to 700° C.

In another embodiment, $T_o$ is such that the supercooling temperature is in the range of 200 to 300° C.

In another embodiment, $T_o$ is such that the supercooling temperature is in the range of 225 to 275° C.

In another embodiment, $T_o$ is such that the supercooling temperature is in the range of 235 to 265° C.

In another embodiment, $T_o$ is such that the normalized supercooling temperature is in the range of 0.25 to 0.5.

In another embodiment, $T_o$ is such that the normalized supercooling temperature is in the range of 0.3 to 0.4.

In another embodiment, $T_o$ is such that the normalized supercooling temperature is in the range of 0.325 to 0.375.

In another embodiment, the viscosity of the sample at $T_o$ is less than $10^5$ Pa-s.

In another embodiment, the viscosity of the sample at $T_o$ is in the range of $10^0$ to $10^5$ Pa-s.

In another embodiment, the viscosity of the sample at $T_o$ is in the range of $10^1$ to $10^4$ Pa-s.

In another embodiment, heating of the sample of the metallic glass-forming alloy is performed by conduction to a hot surface.

In another embodiment, heating of the sample of the metallic glass-forming alloy is performed by inductive heating.

In another embodiment, heating of the sample of the metallic glass-forming alloy is performed by ohmic heating.

In another embodiment, the ohmic heating is performed by the discharge of at least one capacitor.

The disclosure is also directed to a metallic glass-forming alloy or a metallic glass having compositions selected from a group consisting of: $Fe_{67}Ni_7Mo_4P_{13.5}C_6B_{2.5}$, $Fe_{67}Ni_7Mo_4P_{13}C_{6.5}B_{2.5}$, $Fe_{67}Ni_7Mo_4P_{12.5}C_7B_{2.5}$, $Fe_{67}Ni_7Mo_4P_{14}C_6B_2$, $Fe_{67}Ni_7Mo_4P_{13}C_6B_3$, $Fe_{67}Ni_7Mo_4P_{12.5}C_6B_{3.5}$, $Fe_{67}Ni_7Mo_4P_{12}C_6B_4$, $Fe_{66.5}Ni_7Mo_{4.5}P_{13.5}C_6B_{2.5}$, $Fe_{66}Ni_7Mo_5P_{13.5}C_6B_{2.5}$, $Fe_{69}Ni_5Mo_4P_{13.5}C_6B_{2.5}$, $Fe_{65}Ni_9Mo_4P_{13.5}C_6B_{2.5}$, $Fe_{64}Ni_9Cr_1Mo_4P_{13.5}C_6B_{2.5}$, $Fe_{63.5}Ni_9Cr_{1.5}Mo_4P_{13.5}C_6B_{2.5}$, $Fe_{63}Ni_9Cr_2Mo_4P_{13.5}C_6B_{2.5}$, $Fe_{62}Ni_9Cr_3Mo_4P_{13.5}C_6B_{2.5}$, $Fe_{63.7}Ni_{9.03}Cr_{1.51}Mo_{4.01}P_{13.35}C_{5.93}B_{2.47}$, $Fe_{63.1}Ni_{8.94}Cr_{1.49}Mo_{3.97}P_{13.81}C_{6.13}B_{2.56}$, and $Fe_{62.69}Ni_{8.88}Cr_{1.48}Mo_{3.95}P_{14.12}C_{6.27}B_{2.61}$.

DETAILED DESCRIPTION

The disclosure may be understood by reference to the following detailed description, taken in conjunction with the drawings as described below. It is noted that, for purposes of illustrative clarity, certain elements in various drawings may not be drawn to scale.

In the disclosure, the glass-forming ability of an alloy is quantified by the "critical rod diameter," defined as maximum rod diameter in which the amorphous phase can be formed when processed by a method of water quenching a quartz tube with a 0.5 mm thick wall containing the molten alloy.

The "critical cooling rate", which is defined as the cooling rate to avoid crystallization and form the amorphous phase of the alloy (i.e. a metallic glass), determines the "critical rod diameter". The lower the critical cooling rate of an alloy, the larger its critical rod diameter. The critical cooling rate $R_c$ in K/s and critical rod diameter d, in mm are related via the following approximate empirical formula:

$$R_c=1000/d_c^2 \quad \text{Eq. (2)}$$

For example, according to Eq. (2), the critical cooling rate for an alloy having a critical rod diameter of about 3 mm is about $10^2$ K/s.

Generally, three categories are known in the art for identifying the ability of an alloy to form a metallic glass (i.e. to bypass the stable crystal phase and form an amorphous phase). Alloys having critical cooling rates in excess of $10^{12}$ K/s are typically referred to as non-glass formers, as it is very difficult to achieve such cooling rates and form the amorphous phase over a meaningful cross-section thickness (i.e. at least 1 micrometer). Alloys having critical cooling rates in the range of $10^5$ to $10^{12}$ K/s are typically referred to as marginal glass formers, as they are able to form glass over thicknesses ranging from 1 to 100 micrometers according to Eq. (2). Alloys having critical cooling rates on the order of $10^3$ or less, and as low as 1 or 0.1 K/s, are typically referred to as bulk glass formers, as they are able to form glass over thicknesses ranging from 1 millimeter to several centimeters. The glass-forming ability of an alloy (and by extension its critical cooling rate and critical rod diameter) is, to a very large extent, dependent on the composition of the alloy. The compositional ranges for alloys capable of forming marginal glass formers are considerably broader than those for forming bulk glass formers.

Often in the art, a measure of glass forming ability of an alloy is reported as the critical plate thickness instead of the critical rod diameter. Due to its symmetry, the diameter of a rod to achieve a certain cooling rate at the centerline is about twice the thickness of a plate for achieving the same cooling rate at the centerline. Hence, the critical plate thickness to achieve a critical cooling rate is about half the critical rod diameter to achieve the same critical cooling rate. Therefore, a critical plate thickness can be approximately converted to a critical rod diameter by multiplying by 2.

In the disclosure, the thermal stability of the supercooled liquid $\Delta T_x$ is defined as the difference between the crystallization temperature $T_x$ and the glass transition temperature $T_g$ of the metallic glass, $\Delta T_x=T_x-T_g$, measured by calorimetry at a heating rate of 20 K/min.

The thermal stability of the supercooled liquid $\Delta T_x$ is a property defining the ability of the metallic glass to be shaped "thermoplastically" in the supercooled liquid region, i.e. to be shaped by heating the metallic glass to a softening temperature $T_o$ above the glass transition temperature $T_g$, applying a deformational force to shape the metallic glass over a time $t_o$ that is shorter than the time it takes for the softened metallic glass to crystallize at $T_o$, and cooling the metallic glass to a temperature below $T_g$. The higher the thermal stability of the supercooled liquid $\Delta T_x$, the longer the available time $t_o$, which allows for application of the deformational force for longer periods and thus enables larger shaping strains. Also, the higher the thermal stability of the supercooled liquid $\Delta T_x$, the higher the softening temperature $T_o$ that the metallic glass can be heated, which would result in lower viscosities and thus allow larger shaping strains.

In the disclosure, the supercooling temperature is defined as the difference between the softening temperature $T_o$ and the glass transition temperature $T_g$, i.e. $T_o-T_g$, expressed in units of either ° C. or K. Also, the normalized supercooling temperature is defined as the difference between the softening temperature $T_o$ and the glass transition temperature $T_g$, divided by the glass transition temperature $T_g$, i.e. $(T_o-T_g)/T_g$, expressed in units of K/K.

In some embodiments, $T_o$ is higher than $T_g$ and lower than the liquidus temperature of the metallic glass-forming alloy. In one embodiment, $T_o$ is greater than $T_g$ and lower than T. In another embodiment, $T_o$ is higher than $T_x$ and lower than the solidus temperature of the metallic glass-forming alloy.

In another embodiment, $T_o$ is in the range of 550 to 850° C. In another embodiment, $T_o$ is in the range of 575 to 750° C. In yet another embodiment, $T_o$ is in the range of 600 to 700° C. In another embodiment, $T_o$ is such that the supercooling temperature is in the range of 200 to 300° C. In another embodiment, $T_o$ is such that the supercooling temperature is in the range of 225 to 275° C. In yet another embodiment, $T_o$ is such that the supercooling temperature is in the range of 235 to 265° C. In another embodiment, $T_o$ is such that the normalized supercooling temperature is in the range of 0.25 to 0.5. In another embodiment, $T_o$ is such that the normalized supercooling temperature is in the range of 0.3 to 0.4. In yet another embodiment, $T_o$ is such that the normalized supercooling temperature is in the range of 0.325 to 0.375. In some embodiments, the viscosity at $T_o$ is less than $10^5$ Pa-s. In one embodiment, the viscosity at $T_o$ is in the range of $10^0$ to $10^5$ Pa-s. In another embodiment, the viscosity at $T_o$ is in the range of $10^1$ to $10^4$ Pa-s.

In addition to exhibiting large thermal stability of the supercooled liquid $\Delta T_x$, the metallic glasses can be capable of being formed in bulk (i.e. millimeter-thick) dimensions in order to enable "thermoplastic" shaping of bulk 3-dimensional articles. That is, metallic glasses having both a large $\Delta T_x$ and a capability to be formed in bulk dimensions would be suitable for "thermoplastic" shaping of bulk articles. Discovering compositional regions where the alloy demonstrates a high glass forming ability is unpredictable. Discovering compositional regions where the metallic glass formed from an alloy demonstrates a large $\Delta T_x$ is equally unpredictable. Discovering compositional regions where (1) the alloy demonstrates a high glass forming ability and (2) the metallic glass formed from the alloy demonstrates a large $\Delta T_x$ is even more unpredictable than (1) and (2) independently. This is metallic glasses that are capable of being formed at bulk dimensions do not necessarily demonstrate a large $\Delta T_x$, and vice versa. In embodiments of the disclosure it is considered that a critical rod diameter of at least 3 mm for the disclosed alloys and a $\Delta T_x$ of at least 45° C. for the metallic glasses formed from the disclosed alloys may be sufficient to enable "thermoplastic" shaping of bulk 3-dimensional articles. In other embodiments it is considered that a critical rod diameter of at least 3 mm for the disclosed alloys and a $\Delta T_x$ of at least 50° C. for the metallic glasses formed from the disclosed alloys may be sufficient to enable "thermoplastic" shaping of bulk 3-dimensional articles. In yet other embodiments it is considered that a critical rod diameter of at least 5 mm for the disclosed alloys and a $\Delta T_x$ of at least 50° C. for the metallic glasses formed from the disclosed alloys may be sufficient to enable "thermoplastic" shaping of bulk 3-dimensional articles.

In addition to glass-forming ability and thermal stability of the supercooled liquid, another important requirement for broad engineering applicability is the ability of the metallic glass to perform well under mechanical load. Good mechanical performance requires that the metallic glass has a relatively high fracture toughness. In the context of this disclosure, the mechanical performance of the metallic glass is characterized by a high fracture toughness and is quantified by the "critical bending diameter". The critical bending diameter is defined as the maximum diameter in which a rod of the metallic glass, formed by water quenching a quartz capillary containing the molten alloy having a quartz wall thickness equal to about 10% of the rod diameter, can undergo macroscopic plastic bending without fracturing catastrophically.

Therefore, in some embodiments of the disclosure, the metallic glasses formed from the disclosed alloys demonstrate good mechanical performance in addition to exhibiting a large $\Delta T_x$ and an ability to be formed in bulk dimensions. In the context of this disclosure it is considered that a critical bending diameter of at least 0.5 mm may be sufficient to ensure mechanical performance of the metallic glass.

In this disclosure, compositional regions in the Fe—Cr—Ni—Mo—P—C—B alloys are disclosed where the metallic glass-forming alloys demonstrate a high glass forming ability while the metallic glasses formed from the alloys demonstrate a large $\Delta T_x$. In embodiments of the disclosure, the metallic glass-forming alloys demonstrate a critical rod diameter of at least 3 mm, while the metallic glasses formed from the alloys demonstrate a $\Delta T_x$ of at least 45° C. In some embodiments, the critical rod diameter is at least 4 mm, in other embodiments 5 mm, in other embodiments 6 mm, while in other embodiments the critical rod diameter is at least 7 mm. In some embodiments, the thermal stability of the supercooled liquid is at least 47.5° C., in other embodiments at least 50° C., in other embodiments at least 52.5° C., while in other embodiments the thermal stability of the supercooled liquid is at least 55° C.

In some embodiments, the disclose Fe—Cr—Ni—Mo—P—C—B alloys demonstrate a large critical bending diameter, in addition to a high glass forming ability and a large $\Delta T_x$. In embodiments of the disclosure, the metallic glasses formed from the alloys demonstrate a critical bending diameter of at least 0.5 mm. In some embodiments, the critical bending diameter is at least 0.6 mm, in other embodiments at least 0.7 mm, while in other embodiments the critical bending diameter is at least 0.8 mm.

The disclosure is also directed to methods of forming a metallic glass, or an article made of a metallic glass, from the metallic glass-forming alloy. In various embodiments, a metallic glass is formed by heating and melting an alloy ingot to create a molten alloy, and subsequently quenching the molten alloy fast enough to avoid crystallization of the molten alloy. In one embodiment, prior to cooling the molten alloy is heated to at least 100° C. above the liquidus temperature of the metallic glass-forming alloy. In another embodiment, prior to quenching the molten alloy is heated to at least 200° C. above the liquidus temperature of the metallic glass-forming alloy. In another embodiment, prior to quenching the molten alloy is heated to at least 1200° C. In yet another embodiment, prior to quenching the molten alloy is heated to at least 1300° C. In one embodiment, the alloy ingot is heated and melted using a plasma arc. In another embodiment, the alloy ingot is heated and melted using an induction coil. In some embodiments, the alloy ingot is heated and melted inside a quartz crucible or a ceramic crucible. In other embodiments, the alloy ingot is heated and melted over a water-cooled hearth, or within a water-cooled crucible. In one embodiment, the hearth or crucible is made of copper. In some embodiments, the alloy ingot is heated and melted under inert atmosphere. In one embodiment, the inert atmosphere comprises argon gas. In some embodiments, quenching of the molten alloy is performed by injecting or pouring the molten alloy into a metal mold. In some embodiments, the mold can be made of copper, brass, or steel, among other materials. In some embodiments, injection of the molten alloy is performed by a pneumatic drive, a hydraulic drive, an electric drive, or a magnetic drive. In some embodiments, pouring the molten alloy into a metal mold is performed by tilting a tandish containing the molten alloy.

The disclosure is also directed to methods of thermoplastically shaping a metallic glass into an article. In some embodiments, heating of the metallic glass is performed by conduction to a hot surface. In other embodiments, heating of the metallic glass to a softening temperature $T_o$ above the glass transition temperature $T_g$ is performed by inductive heating. In yet other embodiments, heating of the metallic glass to a softening temperature $T_o$ above the glass transition temperature $T_g$ is performed by ohmic heating. In one embodiment, the ohmic heating is performed by the discharge of at least one capacitor. In some embodiments, the application of the deformational force to thermoplastically shape the softened metallic glass in the supercooled liquid region is performed by a pneumatic drive, a hydraulic drive, an electric drive, or a magnetic drive.

Description of the Metallic Glass Forming Region

In various embodiments, the disclosure provides Fe—Cr—Ni—Mo—P—C—B alloys capable of forming metallic glasses. The alloys demonstrate a critical rod diameter of at least 3 mm, and the metallic glasses demonstrate a thermal stability of the supercooled liquid of at least 45° C.

Specifically, the disclosure provides Fe—Cr—Ni—Mo—P—C—B metallic glass-forming alloys and metallic glasses where the total metalloid concentration (i.e. the sum of P, C, and B concentrations) is confined over a narrow range, over which the alloys demonstrate a critical rod diameter of at least 3 mm, while the metallic glasses formed from the alloys demonstrate a thermal stability of the supercooled liquid of at least 45° C. In some embodiments, the metallic glasses formed from the alloys also demonstrate a critical bending diameter of at least 0.5 mm. In various embodiments of the disclosure, the concentration of metalloids ranges from 21.25 to 23.75 atomic percent. In other embodiments, the concentration of metalloids ranges from 21.5 to 23.5 atomic percent. In yet other embodiments, the concentration of metalloids ranges from 21.5 to 23 atomic percent.

In one embodiment, the disclosure provides an alloy capable of forming a metallic glass having a composition represented by the following formula (subscripts denote atomic percentages):

$$Fe_{(100-a-b-c-d-e-f)}Cr_aNi_bMo_cP_dC_eB_f \quad \text{EQ. (1)}$$

a is up to 10;
b ranges from 3 to 13;
c ranges from 2 to 7;
d+e+f ranges from 21.25 to 23.75;
e ranges from 4.5 to 8; and
f ranges from 1 to 9.
wherein the metallic glass-forming alloy has a critical rod diameter of at least 3 mm, and
wherein the thermal stability of the supercooled liquid of the metallic glass against crystallization is at least 45° C.

In another embodiment of the metallic glass-forming alloy or metallic glass, a is up to 9, b ranges from 4 to 12, c ranges from 3 to 6.5, d+e+f ranges from 21.5 to 23.5, e ranges from 5.25 to 7.5, f ranges from 1.5 to 8.5, wherein the metallic glass-forming alloy has a critical rod diameter of at least 4 mm, and wherein the thermal stability of the supercooled liquid of the metallic glass against crystallization is at least 47.5° C.

In another embodiment of the metallic glass-forming alloy or metallic glass, a is up to 8, b ranges from 4.5 to 10, c ranges from 3.5 to 5.5, d+e+f ranges from 21.5 to 23, e ranges from 5.5 to 7, f ranges from 2 to 7.5, wherein the metallic glass-forming alloy has a critical rod diameter of at least 5 mm, and wherein the thermal stability of the supercooled liquid of the metallic glass against crystallization is at least 50° C.

Specific embodiments of metallic glasses formed of metallic glass-forming alloys with compositions according to the formula $Fe_{67}Ni_7Mo_4P_{19.5-x}C_xB_{2.5}$ are presented in Tables 1 and 2. In these alloys, P is substituted by C, where the atomic fraction of C varies from 4 to 8 percent, the atomic fraction of P varies from 11.5 to 15.5 percent, while the atomic fractions of Fe, Ni, Mo, and B are fixed at 67, 7, 4, and 2.5, respectively.

Figure 2:
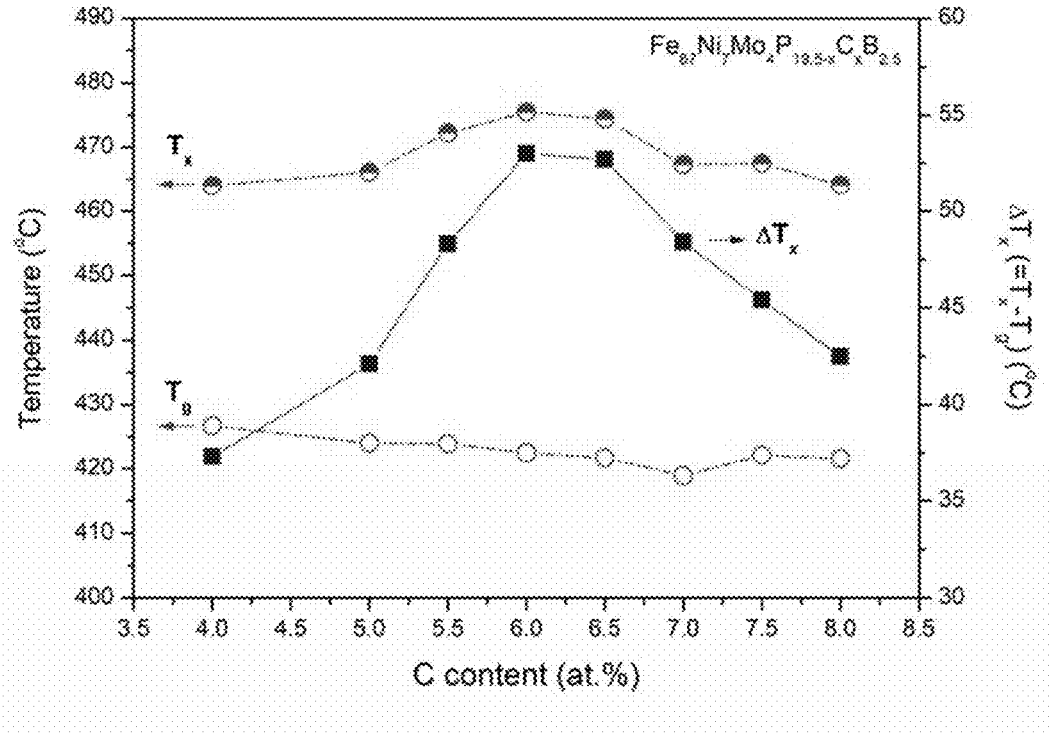
FIG. 2 provides a data plot showing the effect of substituting P by C according to the composition formula $Fe_{67}Ni_7Mo_4P_{19.5-x}C_xB_{2.5}$ on the glass-transition and crystallization temperatures and thermal stability of the supercooled liquid $\Delta T_x$ in accordance with embodiments of the disclosure.

FIG. 1 provides calorimetry scans for sample metallic glasses according to the formula $Fe_{67}Ni_7Mo_4P_{19.5-x}C_xB_{2.5}$ in accordance with embodiments of the disclosure. The glass transition temperature $T_g$ and crystallization temperature $T_x$ of the metallic glasses are indicated by arrows in FIG. 1, and are listed in Table 1, along with the difference between crystallization and glass-transition temperatures indicating $\Delta T_x = T_x - T_g$. The liquidus temperature $T_l$ and solidus temperature $T_s$ of the alloys are also indicated by arrows in FIG. 1 and are listed in Table 1. FIG. 2 provides a data plot showing the effect of substituting P by C according to the composition formula $Fe_{67}Ni_7Mo_4P_{19.5-}C_xB_{2.5}$ on the glass-transition and crystallization temperatures and thermal stability of the supercooled liquid $\Delta T_x$ of metallic glasses.

TABLE 1

Sample metallic glasses demonstrating the effect of substituting P by C according to the formula $Fe_{67}Ni_7Mo_4P_{19.5-x}C_xB_{2.5}$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) | $T_s$ (° C.) | $T_l$ (° C.) |
|---|---|---|---|---|---|---|
| 1 | $Fe_{67}Ni_7Mo_4P_{15.5}C_4B_{2.5}$ | 426.7 | 464.0 | 37.3 | 918.6 | 1025.8 |
| 2 | $Fe_{67}Ni_7Mo_4P_{14.5}C_5B_{2.5}$ | 424.0 | 466.1 | 42.1 | 912.8 | 1011.0 |
| 3 | $Fe_{67}Ni_7Mo_4P_{14}C_{5.5}B_{2.5}$ | 423.9 | 472.2 | 48.3 | 912.4 | 999.8 |
| 4 | $Fe_{67}Ni_7Mo_4P_{13.5}C_6B_{2.5}$ | 422.5 | 475.5 | 53.0 | 911.4 | 993.8 |
| 5 | $Fe_{67}Ni_7Mo_4P_{13}C_{6.5}B_{2.5}$ | 421.7 | 474.4 | 52.7 | 908.1 | 985.2 |
| 6 | $Fe_{67}Ni_7Mo_4P_{12.5}C_7B_{2.5}$ | 418.9 | 467.3 | 48.4 | 907.7 | 975.8 |
| 7 | $Fe_{67}Ni_7Mo_4P_{12}C_{7.5}B_{2.5}$ | 422.1 | 467.5 | 45.4 | 908.6 | 969.9 |
| 8 | $Fe_{67}Ni_7Mo_4P_{11.5}C_8B_{2.5}$ | 421.6 | 464.1 | 42.5 | 910.5 | 961.1 |

As shown in Table 1 and FIGS. 1 and 2, substituting P by C according to $Fe_{67}Ni_7Mo_4P_{19.5-x}C_xB_{2.5}$ results in varying thermal stability of the supercooled liquid. The glass-transition temperature $T_g$ decreases from 426.7° C. for the metallic glass containing 4 atomic percent C (Example 1), reaches the lowest value of 418.9° C. for the metallic glass containing 7 atomic percent C (Example 6), and increases back to 421.6° C. for the metallic glass containing 8 atomic percent C (Example 8). The crystallization temperature $T_x$ increases from 464.0° C. for the metallic glass containing 4 atomic percent C (Example 1), reaches the highest value of 475.5° C. for the metallic glass containing 6 atomic percent C (Example 4), and decreases back to 464.4° C. for the metallic glass containing 8 atomic percent C (Example 8). The stability for the supercooled liquid $\Delta T_x$ increases from 37.3° C. for the metallic glass containing 4 atomic percent C (Example 1), reaches the highest value of 53.0° C. for the metallic glass containing 6 atomic percent C (Example 4), and decreases back to 42.5° C. for the metallic glass containing 8 atomic percent C (Example 8).

Figure 3:
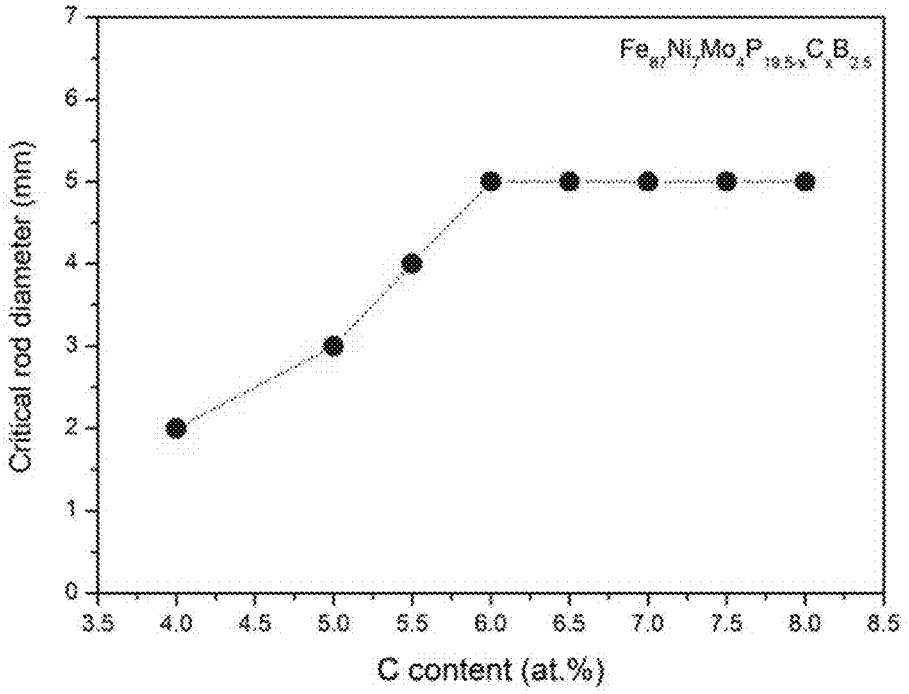
FIG. 3 provides a data plot showing the effect of substituting P by C according to the composition formula $Fe_{67}Ni_7Mo_4P_{19.5-x}C_xB_{2.5}$ on the critical rod diameter of the alloys in accordance with embodiments of the disclosure.

The critical rod diameter of the example alloys according to the composition formula $Fe_{67}Ni_7Mo_4P_{19.5-x}C_xB_{2.5}$ is listed in Table 2 and is plotted in FIG. 3. As shown in Table 2 and FIG. 3, substituting P by C according to $Fe_{67}Ni_7Mo_4P_{19.5-x}C_xB_{2.5}$ results in varying glass forming ability. Specifically, the critical rod diameter increases from 2 mm for the metallic glass-forming alloy containing 4 atomic percent C (Example 1), reaches the highest value of 5 mm for the metallic glass-forming alloy containing 6 atomic percent C (Example 4), and remains constant at 5 mm for the metallic glass-forming alloys containing 6-8 atomic percent C (Examples 4-8).

TABLE 2

Sample metallic glasses demonstrating the effect of substituting P by C according to the formula $Fe_{67}Ni_7Mo_4P_{19.5-x}C_xB_{2.5}$ on the critical rod diameter of the alloy and critical bending diameter of the metallic glass, respectively.

| Example | Composition | Critical Rod Diameter [mm] | Critical Bending diameter [mm] |
|---|---|---|---|
| 1 | $Fe_{67}Ni_7Mo_4P_{15.5}C_4B_{2.5}$ | 2 | 0.7 |
| 2 | $Fe_{67}Ni_7Mo_4P_{14.5}C_5B_{2.5}$ | 3 | 0.7 |
| 3 | $Fe_{67}Ni_7Mo_4P_{14}C_{5.5}B_{2.5}$ | 4 | 0.8 |
| 4 | $Fe_{67}Ni_7Mo_4P_{13.5}C_6B_{2.5}$ | 5 | 0.8 |
| 5 | $Fe_{67}Ni_7Mo_4P_{13}C_{6.5}B_{2.5}$ | 5 | 0.8 |
| 6 | $Fe_{67}Ni_7Mo_4P_{12.5}C_7B_{2.5}$ | 5 | 0.9 |

TABLE 2-continued

Sample metallic glasses demonstrating the effect of substituting P by C according to the formula $Fe_{67}Ni_7Mo_4P_{19.5-x}C_xB_{2.5}$ on the critical rod diameter of the alloy and critical bending diameter of the metallic glass, respectively.

| Example | Composition | Critical Rod Diameter [mm] | Critical Bending diameter [mm] |
|---|---|---|---|
| 7 | $Fe_{67}Ni_7Mo_4P_{12}C_{7.5}B_{2.5}$ | 5 | 0.9 |
| 8 | $Fe_{67}Ni_7Mo_4P_{11.5}C_8B_{2.5}$ | 5 | 0.9 |

The critical bending diameter of the example metallic glasses according to the composition formula $Fe_{67}Ni_7Mo_4P_{19.5-x}C_xB_{2.5}$ is also listed in Table 2. As shown in Table 2, substituting P by C according to $Fe_{67}Ni_7Mo_4P_{19.5-x}C_xB_{2.5}$ results in increasing bending ductility. Specifically, the critical bending diameter increases from 0.7 mm for the metallic glasses containing 4-5 atomic percent C (Examples 1 and 2), to 0.8 mm for the metallic glasses containing 5.5-6.5 atomic percent C (Examples 3-5), to 0.9 mm for the metallic glasses containing 7-8 atomic percent C (Examples 6-8).

Specific embodiments of metallic glasses formed of metallic glass-forming alloys with compositions according to the formula $Fe_{67}Ni_7Mo_4P_{16-x}C_6B_x$ are presented in Tables 3 and 4. In these alloys, P is substituted by B, where the atomic fraction of B varies from 1 to 9 percent, the atomic fraction of P varies from 7 to 15 percent, while the atomic fractions of Fe, Ni, Mo, and C are fixed at 67, 7, 4, and 6, respectively.

Figure 4:
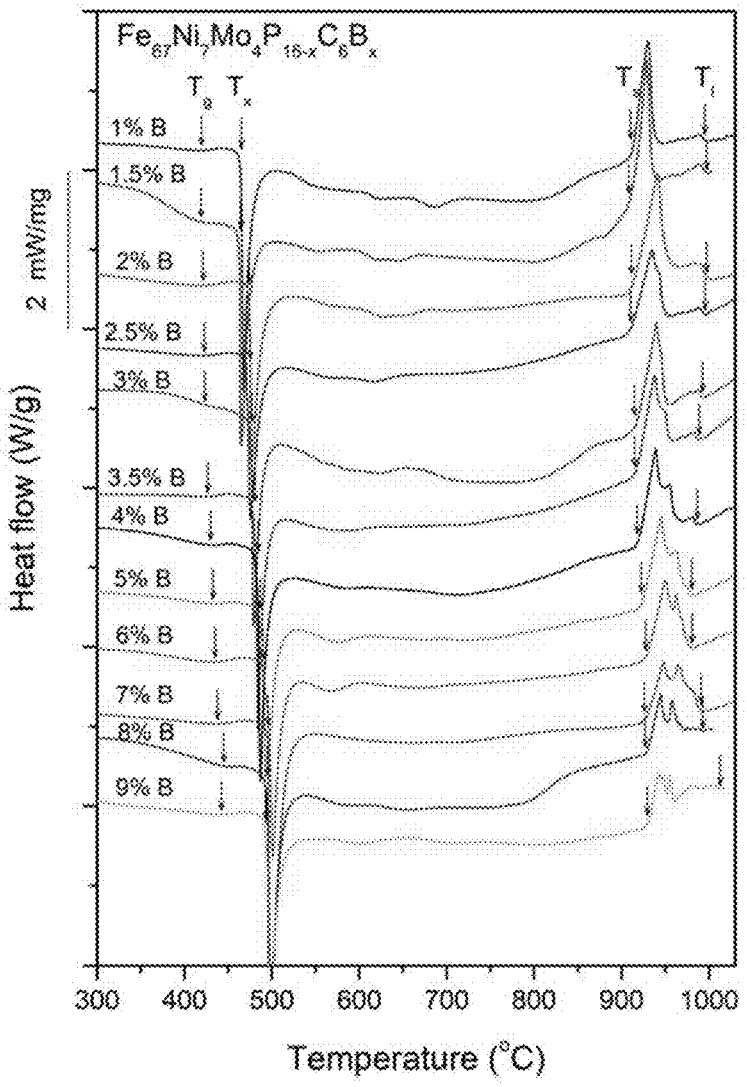
FIG. 4 provides calorimetry scans for sample metallic glasses according to $Fe_{67}Ni_7Mo_4P_{1.6-x}C_6B_x$ in accordance with embodiments of the disclosure. The glass transition temperature $T_g$ and crystallization temperature $T_x$ are indicated by arrows.
Figure 5:
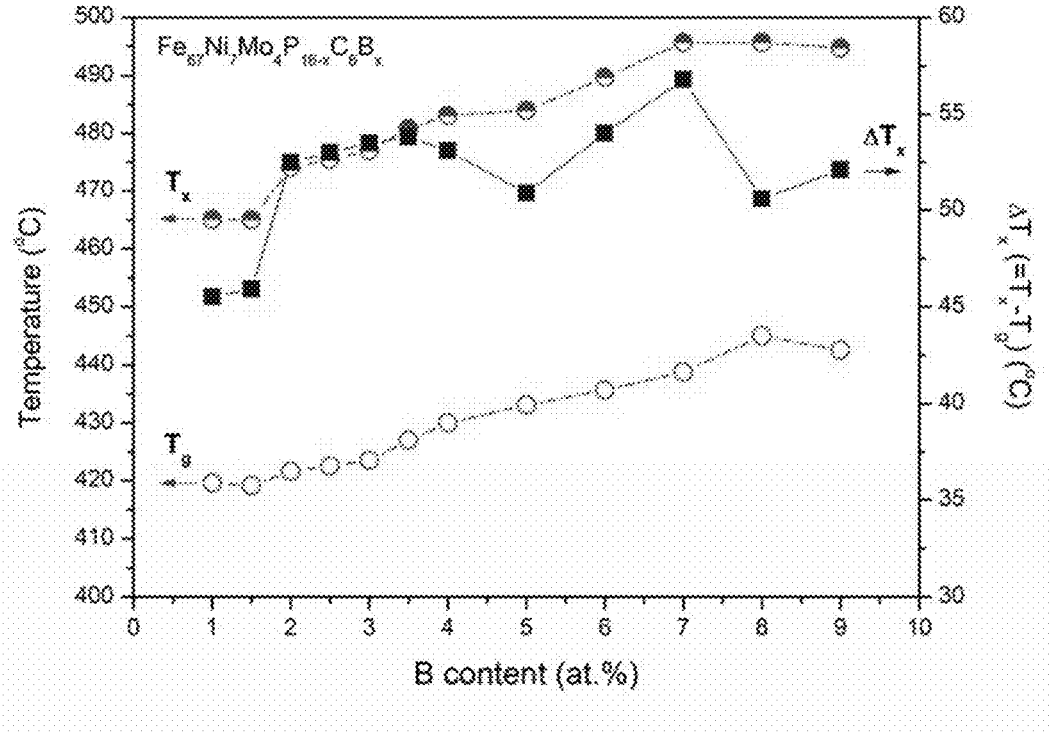
FIG. 5 provides a data plot showing the effect of substituting P by B according to the composition formula $Fe_{67}Ni_7Mo_4P_{16-x}C_6B_x$ on the glass-transition and crystallization temperatures and thermal stability of the supercooled liquid $\Delta T_x$ in accordance with embodiments of the disclosure.

FIG. 4 provides calorimetry scans for sample metallic glasses according to the formula $Fe_{67}Ni_7Mo_4P_{16-x}C_6B_x$ in accordance with embodiments of the disclosure. The glass transition temperature $T_g$ and crystallization temperature $T_x$ of the metallic glasses are indicated by arrows in FIG. 4, and are listed in Table 3, along with the difference between crystallization and glass-transition temperatures indicating $\Delta T_x = T_x - T_g$. The liquidus temperature $T_l$ and solidus temperature $T_s$ of the alloys are also indicated by arrows in FIG. 4 and are listed in Table 3. FIG. 5 provides a data plot showing the effect of substituting P by B according to the composition formula $Fe_{67}Ni_7Mo_4P_{16-x}C_6B_x$ on the glass-transition and crystallization temperatures and thermal stability of the supercooled liquid $\Delta T_x$ of metallic glasses.

TABLE 3

Sample metallic glasses demonstrating the effect of substituting P by B according to the formula $Fe_{67}Ni_7Mo_4P_{16-x}C_6B_x$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) | $T_s$ (° C.) | $T_l$ (° C.) |
|---|---|---|---|---|---|---|
| 9 | $Fe_{67}Ni_7Mo_4P_{15}C_6B_1$ | 419.6 | 465.1 | 45.5 | 912.1 | 994.6 |
| 10 | $Fe_{67}Ni_7Mo_4P_{14.5}C_6B_{1.5}$ | 419.1 | 465.0 | 45.9 | 909.7 | 996.4 |
| 11 | $Fe_{67}Ni_7Mo_4P_{14}C_6B_2$ | 421.6 | 474.1 | 52.5 | 909.9 | 997.2 |
| 4 | $Fe_{67}Ni_7Mo_4P_{13.5}C_6B_{2.5}$ | 422.5 | 475.5 | 53.0 | 911.4 | 993.8 |
| 12 | $Fe_{67}Ni_7Mo_4P_{13}C_6B_3$ | 423.5 | 477.0 | 53.5 | 916.9 | 992.5 |
| 13 | $Fe_{67}Ni_7Mo_4P_{12.5}C_6B_{3.5}$ | 427.0 | 480.8 | 53.8 | 916.8 | 987.6 |
| 14 | $Fe_{67}Ni_7Mo_4P_{12}C_6B_4$ | 430.0 | 483.1 | 53.1 | 918.9 | 986.1 |
| 15 | $Fe_{67}Ni_7Mo_4P_{11}C_6B_5$ | 433.1 | 484.0 | 50.9 | 922.8 | 979.3 |
| 16 | $Fe_{67}Ni_7Mo_4P_{10}C_6B_6$ | 435.7 | 489.7 | 54.0 | 928.6 | 980.3 |
| 17 | $Fe_{67}Ni_7Mo_4P_9C_6B_7$ | 438.8 | 495.6 | 56.8 | 927.0 | 989.2 |
| 18 | $Fe_{67}Ni_7Mo_4P_8C_6B_8$ | 445.0 | 495.6 | 50.6 | 929.7 | 992.4 |
| 19 | $Fe_{67}Ni_7Mo_4P_7C_6B_9$ | 442.6 | 494.7 | 52.1 | 930.2 | 1012.9 |

As shown in Table 3 and FIGS. 4 and 5, substituting P by B according to $Fe_{67}Ni_7Mo_4P_{16-x}C_6B_x$ results in varying thermal stability of the supercooled liquid. The glass-transition temperature $T_g$ increases roughly monotonically from 419.6° C. for the metallic glass containing 1 atomic percent B (Example 9) to 442.6° C. for the metallic glass containing 9 atomic percent B (Example 19). The crystallization temperature $T_x$ also increases roughly monotonically from 465.1° C. for the metallic glass containing 1 atomic percent B (Example 9) to 494.7° C. for the metallic glass containing 9 atomic percent B (Example 19). The stability for the supercooled liquid $\Delta T_x$ also increases roughly monotonically from 45.5° C. for the metallic glass containing 1 atomic percent B (Example 9) to 52.1° C. for the metallic glass containing 9 atomic percent B (Example 19).

Figure 6:
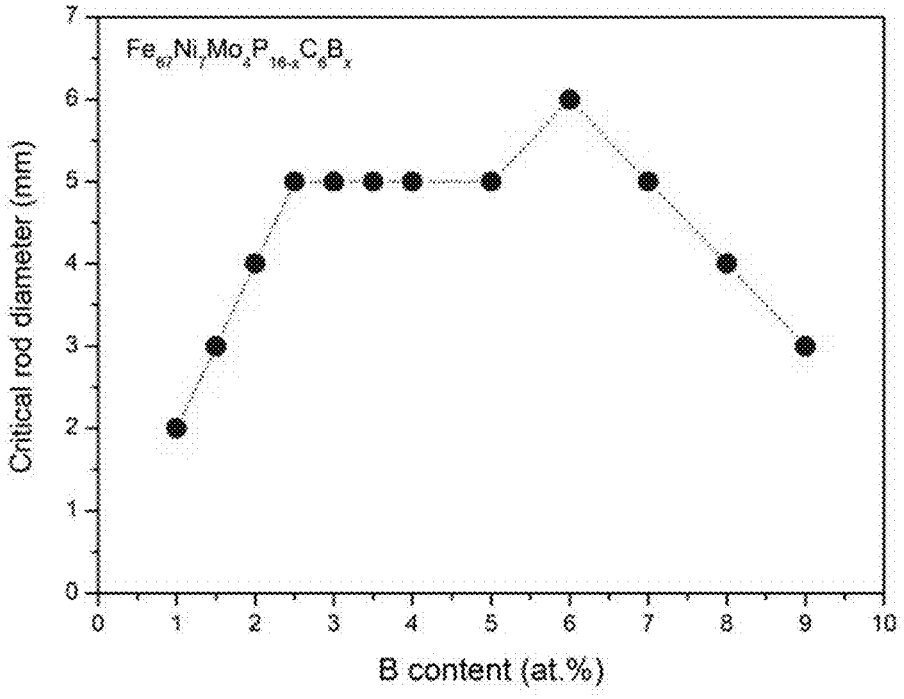
FIG. 6 provides a data plot showing the effect of substituting P by B according to the composition formula $Fe_{67}Ni_7Mo_4P_{16-x}C_6B_x$ on the critical rod diameter of the alloys in accordance with embodiments of the disclosure.

The critical rod diameter of the example alloys according to the composition formula $Fe_{67}Ni_7Mo_4P_{16-x}C_6B_x$ is listed in Table 4 and is plotted in FIG. 6. As shown in Table 4 and FIG. 6, substituting P by B according to $Fe_{67}Ni_7Mo_4P_{16-x}C_6B_x$ results in varying glass forming ability. Specifically, the critical rod diameter increases from 2 mm for the metallic glass-forming alloy containing 1 atomic percent B (Example 9), reaches the highest value of 6 mm for the metallic glass-forming alloy containing 6 atomic percent B (Example 16), and decreases back to 3 mm for the metallic glass-forming alloy containing 9 atomic percent B (Example 19).

TABLE 4

Sample metallic glasses demonstrating the effect of substituting P by B according to the formula $Fe_{67}Ni_7Mo_4P_{16-x}C_6B_x$ on the critical rod diameter of the alloy and critical bending diameter of the metallic glass, respectively.

| Example | Composition | Critical Rod Diameter [mm] | Critical Bending Diameter [mm] |
|---|---|---|---|
| 9 | $Fe_{67}Ni_7Mo_4P_{15}C_6B_1$ | 2 | 0.8 |
| 10 | $Fe_{67}Ni_7Mo_4P_{14.5}C_6B_{1.5}$ | 3 | 0.8 |
| 11 | $Fe_{67}Ni_7Mo_4P_{14}C_6B_2$ | 4 | 0.8 |

TABLE 4-continued

Sample metallic glasses demonstrating the effect of substituting P by B according to the formula $Fe_{67}Ni_7Mo_4P_{16-x}C_6B_x$ on the critical rod diameter of the alloy and critical bending diameter of the metallic glass, respectively.

| Example | Composition | Critical Rod Diameter [mm] | Critical Bending Diameter [mm] |
|---|---|---|---|
| 4 | $Fe_{67}Ni_7Mo_4P_{13.5}C_6B_{2.5}$ | 5 | 0.8 |
| 12 | $Fe_{67}Ni_7Mo_4P_{13}C_6B_3$ | 5 | 0.6 |
| 13 | $Fe_{67}Ni_7Mo_4P_{12.5}C_6B_{3.5}$ | 5 | 0.6 |
| 14 | $Fe_{67}Ni_7Mo_4P_{12}C_6B_4$ | 5 | 0.6 |
| 15 | $Fe_{67}Ni_7Mo_4P_{11}C_6B_5$ | 5 | 0.4 |
| 16 | $Fe_{67}Ni_7Mo_4P_{10}C_6B_6$ | 6 | 0.4 |
| 17 | $Fe_{67}Ni_7Mo_4P_9C_6B_7$ | 5 | 0.4 |
| 18 | $Fe_{67}Ni_7Mo_4P_8C_6B_8$ | 4 | 0.3 |
| 19 | $Fe_{67}Ni_7Mo_4P_7C_6B_9$ | 3 | 0.3 |

The critical bending diameter of the example metallic glasses according to the composition formula $Fe_{67}Ni_7Mo_4P_{16-x}C_6B_x$ is also listed in Table 4. As shown in Table 4, substituting P by B according to $Fe_{67}Ni_7Mo_4P_{16-x}C_6B_x$ results in decreasing bending ductility. Specifically, the critical bending diameter decreases from 0.8 mm for the metallic glasses containing 1-2.5 atomic percent B (Examples 4 and 9-11), to 0.6 mm for the metallic glasses containing 3-4 atomic percent B (Examples 12-14), to 0.4 mm for the metallic glasses containing 5-7 atomic percent B (Examples 15-17), to 0.3 mm for the metallic glasses containing 8-9 atomic percent B (Examples 18 and 19).

Specific embodiments of metallic glasses formed of metallic glass-forming alloys with compositions according to the formula $Fe_{71-x}Ni_7Mo_xP_{13.5}C_6B_{2.5}$ are presented in Tables 5 and 6. In these alloys, Fe is substituted by Mo, where the atomic fraction of Mo varies from 2 to 7 percent, the atomic fraction of Fe varies from 64 to 69 percent, while the atomic fractions of Ni, P, C, and B are fixed at 7, 13.5, 6, and 2.5, respectively.

Figure 7:
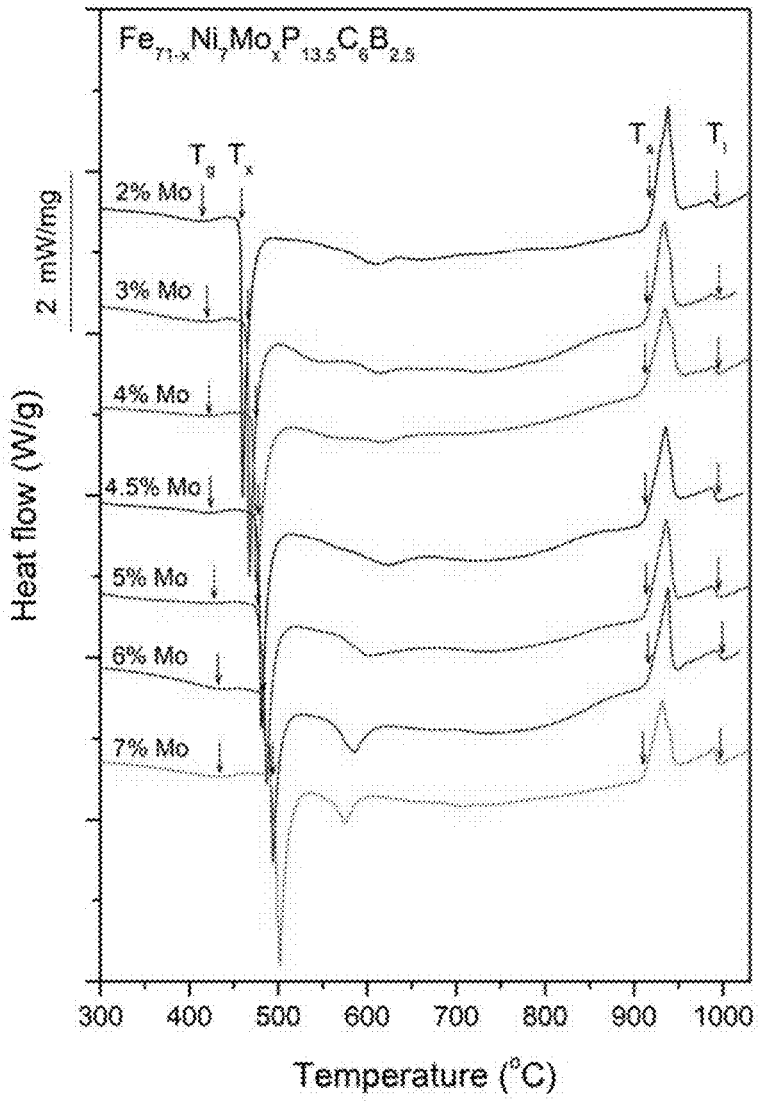
FIG. 7 provides calorimetry scans for sample metallic glasses according to $Fe_{71-x}$ $Ni_7Mo_xP_{13.5}C_6B_{2.5}$ in accordance with embodiments of the disclosure. The glass transition temperature $T_g$ and crystallization temperature $T_x$ are indicated by arrows.
Figure 8:
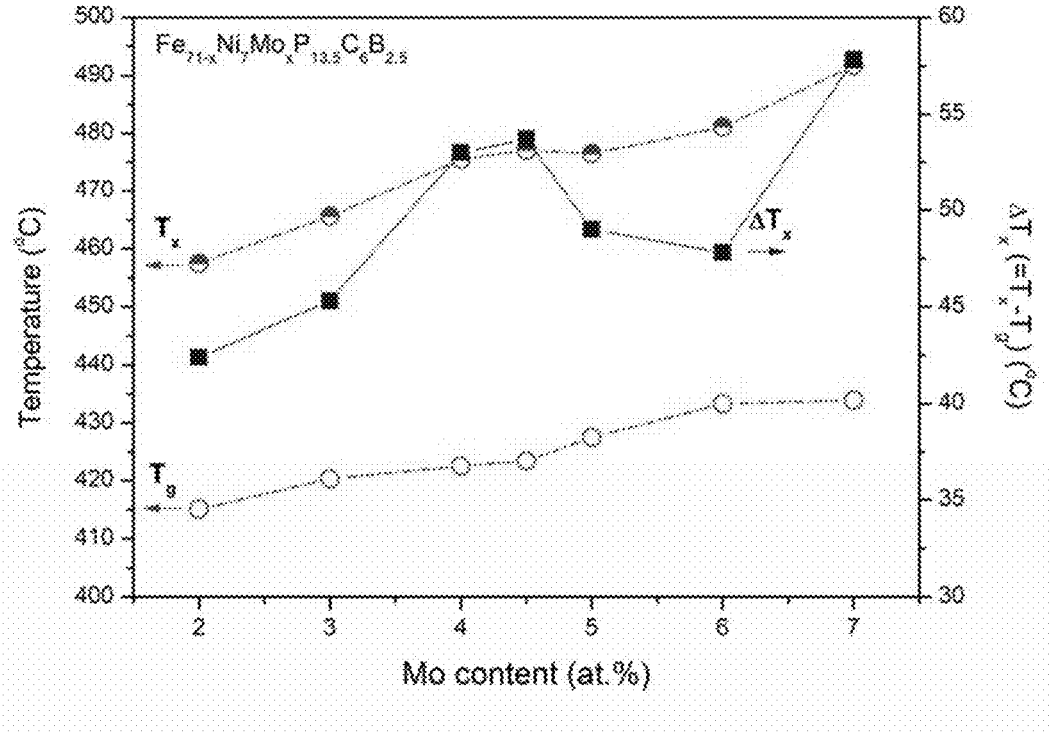
FIG. 8 provides a data plot showing the effect of substituting Fe by Mo according to the composition formula $Fe_{71-x}Ni_7Mo_xP_{13.5}C_6B_{2.5}$ on the glass-transition and crystallization temperatures and thermal stability of the supercooled liquid $\Delta T_x$ in accordance with embodiments of the disclosure.

FIG. 7 provides calorimetry scans for sample metallic glasses according to the formula $Fe_{71-x}Ni_7Mo_xP_{13.5}C_6B_{2.5}$ in accordance with embodiments of the disclosure. The glass transition temperature $T_g$ and crystallization temperature $T_x$ of the metallic glasses are indicated by arrows in FIG. 7, and are listed in Table 5, along with the difference between crystallization and glass-transition temperatures indicating $\Delta T_x = T_x - T_g$. The liquidus temperature $T_l$ and solidus temperature $T_s$ of the alloys are also indicated by arrows in FIG. 7 and are listed in Table 5. FIG. 8 provides a data plot showing the effect of substituting Fe by Mo according to the composition formula $Fe_{71-x}Ni_7Mo_xP_{13.5}C_6B_{2.5}$ on the glass-transition and crystallization temperatures and thermal stability of the supercooled liquid $\Delta T_x$ of metallic glasses.

TABLE 5

Sample metallic glasses demonstrating the effect of substituting Fe by Mo according to the formula $Fe_{71-x}Ni_7Mo_xP_{13.5}C_6B_{2.5}$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) | $T_s$ (° C.) | $T_l$ (° C.) |
|---|---|---|---|---|---|---|
| 20 | $Fe_{69}Ni_7Mo_2P_{13.5}C_6B_{2.5}$ | 415.1 | 457.5 | 42.4 | 917.9 | 992.7 |
| 21 | $Fe_{68}Ni_7Mo_3P_{13.5}C_6B_{2.5}$ | 420.3 | 465.6 | 45.3 | 913.9 | 995.0 |
| 4 | $Fe_{67}Ni_7Mo_4P_{13.5}C_6B_{2.5}$ | 422.5 | 475.5 | 53.0 | 911.4 | 993.8 |
| 22 | $Fe_{66.5}Ni_7Mo_{4.5}P_{13.5}C_6B_{2.5}$ | 423.4 | 477.1 | 53.7 | 911.7 | 993.3 |
| 23 | $Fe_{66}Ni_7Mo_5P_{13.5}C_6B_{2.5}$ | 427.5 | 476.5 | 49.0 | 912.3 | 994.6 |
| 24 | $Fe_{65}Ni_7Mo_6P_{13.5}C_6B_{2.5}$ | 433.3 | 481.1 | 47.8 | 914.2 | 998.7 |
| 25 | $Fe_{64}Ni_7Mo_7P_{13.5}C_6B_{2.5}$ | 433.9 | 491.7 | 57.8 | 910.6 | 994.3 |

As shown in Table 5 and FIGS. 7 and 8, substituting Fe by Mo according to $Fe_{71-x}Ni_7Mo_xP_{13.5}C_6B_{2.5}$ results in varying thermal stability of the supercooled liquid. The glass-transition temperature $T_g$ increases roughly monotonically from 415.1° C. for the metallic glass containing 2 atomic percent Mo (Example 20) to 433.9° C. for the metallic glass containing 7 atomic percent Mo (Example 25). The crystallization temperature $T_x$ also increases roughly monotonically from 457.5° C. for the metallic glass containing 2 atomic percent Mo (Example 20) to 491.7° C. for the metallic glass containing 7 atomic percent Mo (Example 25). The stability for the supercooled liquid $\Delta T_x$ also increases roughly monotonically from 42.4° C. for the metallic glass containing 2 atomic percent Mo (Example 20) to 57.8° C. for the metallic glass containing 7 atomic percent Mo (Example 25).

Figure 9:
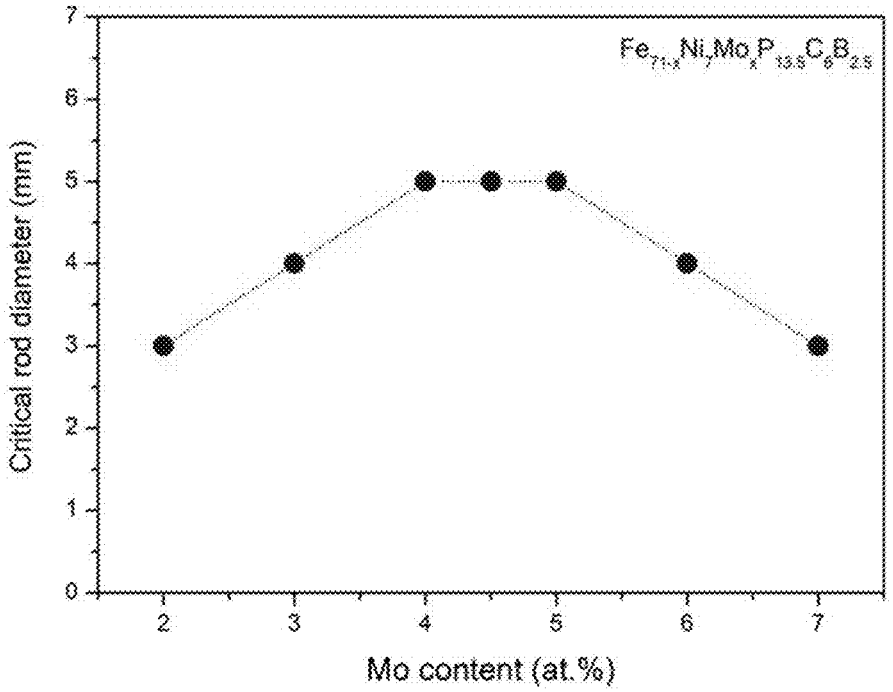
FIG. 9 provides a data plot showing the effect of substituting Fe by Mo according to the composition formula $Fe_{71-x}Ni_7Mo_xP_{13.5}C_6B_{2.5}$ on the critical rod diameter of the alloys in accordance with embodiments of the disclosure.

The critical rod diameter of the example alloys according to the composition formula $Fe_{71-x}Ni_7Mo_xP_{13.5}C_6B_{2.5}$ is listed in Table 6 and is plotted in FIG. 9. As shown in Table 6 and FIG. 9, substituting Fe by Mo according to $Fe_{71-x}Ni_7Mo_xP_{13.5}C_6B_{2.5}$ results in varying glass forming ability. Specifically, the critical rod diameter increases from 3 mm for the metallic glass-forming alloy containing 2 atomic percent Mo (Example 20), reaches the highest value of 5 mm for the metallic glass-forming alloys containing 4-5 atomic percent Mo (Examples 4, 22, 23), and decreases back to 3 mm for the metallic glass-forming alloy containing 7 atomic percent Mo (Example 25).

TABLE 6

Sample metallic glasses demonstrating the effect of substituting Fe by Mo according to the formula $Fe_{71-x}Ni_7Mo_xP_{13.5}C_6B_{2.5}$ on the critical rod diameter of the alloy and critical bending diameter of the metallic glass, respectively.

| Example | Composition | Critical Rod Diameter [mm] | Critical Bending Diameter [mm] |
|---|---|---|---|
| 20 | $Fe_{69}Ni_7Mo_2P_{13.5}C_6B_{2.5}$ | 3 | 1.0 |
| 21 | $Fe_{68}Ni_7Mo_3P_{13.5}C_6B_{2.5}$ | 4 | 0.9 |

TABLE 6-continued

Sample metallic glasses demonstrating the effect of substituting Fe by Mo according to the formula $Fe_{71-x}Ni_7Mo_xP_{13.5}C_6B_{2.5}$ on the critical rod diameter of the alloy and critical bending diameter of the metallic glass, respectively.

| Example | Composition | Critical Rod Diameter [mm] | Critical Bending Diameter [mm] |
|---|---|---|---|
| 4 | $Fe_{67}Ni_7Mo_4P_{13.5}C_6B_{2.5}$ | 5 | 0.8 |
| 22 | $Fe_{66.5}Ni_7Mo_{4.5}P_{13.5}C_6B_{2.5}$ | 5 | 0.7 |
| 23 | $Fe_{66}Ni_7Mo_5P_{13.5}C_6B_{2.5}$ | 5 | 0.7 |
| 24 | $Fe_{65}Ni_7Mo_6P_{13.5}C_6B_{2.5}$ | 4 | 0.6 |
| 25 | $Fe_{64}Ni_7Mo_7P_{13.5}C_6B_{2.5}$ | 3 | 0.5 |

The critical bending diameter of the example metallic glasses according to the composition formula $Fe_{71-x}Ni_7Mo_xP_{13.5}C_6B_{2.5}$ is also listed in Table 6. As shown in Table 6, substituting Fe by Mo according to $Fe_{71-x}Ni_7Mo_xP_{13.5}C_6B_{2.5}$ results in decreasing bending ductility. Specifically, the critical bending diameter decreases from 1.0 mm for the metallic glass containing 2 atomic percent Mo (Example 20), to 0.9 mm for the metallic glass containing 3 atomic percent Mo (Example 21), to 0.8 mm for the metallic glass containing 4 atomic percent Mo (Example 4), to 0.7 mm for the metallic glasses containing 4.5-5 atomic percent Mo (Examples 22 and 23), to 0.6 mm for the metallic glass containing 6 atomic percent Mo (Example 24), to 0.5 mm for the metallic glass containing 7 atomic percent Mo (Example 25).

Specific embodiments of metallic glasses formed of metallic glass-forming alloys with compositions according to the formula $Fe_{74-x}Ni_xMo_4P_{13.5}C_6B_{2.5}$ are presented in Tables 5 and 6. In these alloys, Fe is substituted by Ni, where the atomic fraction of Ni varies from 3 to 13 percent, the atomic fraction of Fe varies from 61 to 71 percent, while the atomic fractions of Mo, P, C, and B are fixed at 4, 13.5, 6, and 2.5, respectively.

Figure 10:
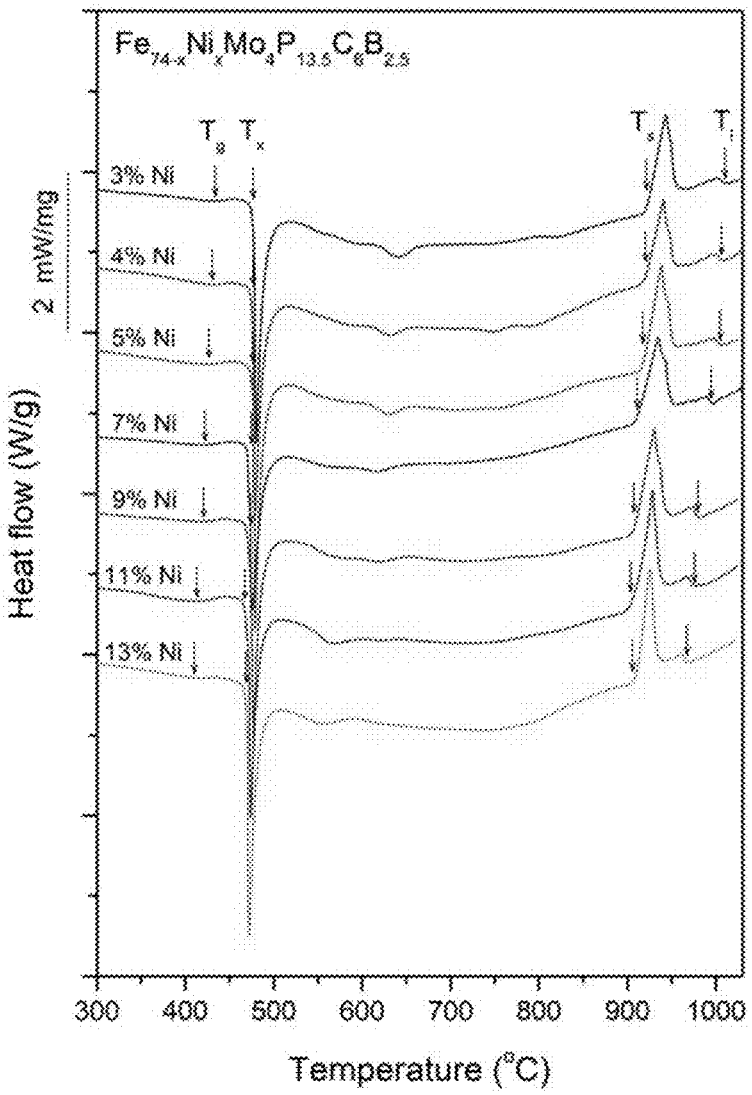
FIG. 10 provides calorimetry scans for sample metallic glasses according to $Fe_{74-x}Ni_xMo_4P_{13.5}C_6B_{2.5}$ in accordance with embodiments of the disclosure. The glass transition temperature $T_g$ and crystallization temperature $T_x$ are indicated by arrows.
Figure 11:
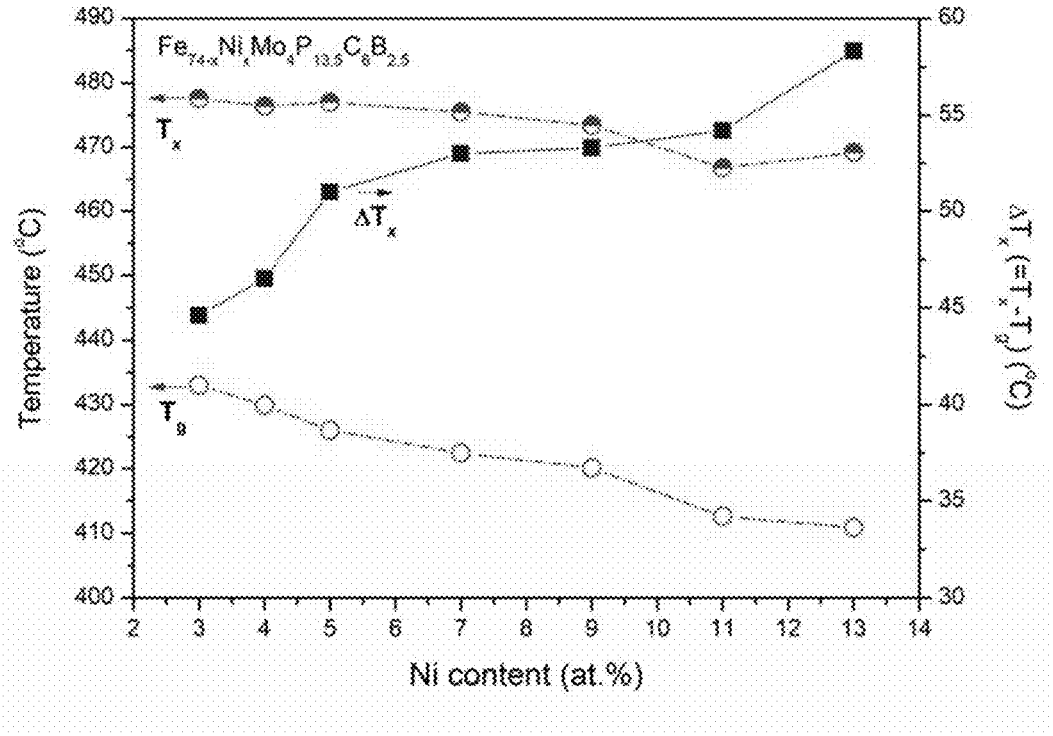
FIG. 11 provides a data plot showing the effect of substituting Fe by Ni according to the composition formula $Fe_{74-x}Ni_xMo_4P_{13.5}C_6B_{2.5}$ on the glass-transition and crystallization temperatures and thermal stability of the supercooled liquid $\Delta T_x$ in accordance with embodiments of the disclosure.

FIG. 10 provides calorimetry scans for sample metallic glasses according to the formula $Fe_{74-x}Ni_xMo_4P_{13.5}C_6B_{2.5}$ in accordance with embodiments of the disclosure. The glass transition temperature $T_g$ and crystallization temperature $T_x$ of the metallic glasses are indicated by arrows in FIG. 10, and are listed in Table 7, along with the difference between crystallization and glass-transition temperatures indicating $\Delta T_x = T_x - T_g$. The liquidus temperature $T_l$ and solidus temperature $T_s$ of the alloys are also indicated by arrows in FIG. 10 and are listed in Table 7. FIG. 11 provides a data plot showing the effect of substituting Fe by Ni according to the composition formula $Fe_{74-x}Ni_xMo_4P_{13.5}C_6B_{2.5}$ on the glass-transition and crystallization temperatures and thermal stability of the supercooled liquid $\Delta T_x$ of metallic glasses.

As shown in Table 7 and FIGS. 10 and 11, substituting Fe by Ni according to $Fe_{74-x}Ni_xMo_4P_{13.5}C_6B_{2.5}$ results in varying thermal stability of the supercooled liquid. The glass-transition temperature $T_g$ decreases roughly monotonically from 433.0° C. for the metallic glass containing 3 atomic percent Ni (Example 26) to 410.9° C. for the metallic glass containing 13 atomic percent Ni (Example 31). The crystallization temperature $T_x$ also decreases roughly monotonically from 477.6° C. for the metallic glass containing 3 atomic percent Ni (Example 26) to 469.2° C. for the metallic glass containing 13 atomic percent Ni (Example 31). The stability for the supercooled liquid $\Delta T_x$ on the other hand increases roughly monotonically from 44.6° C. for the metallic glass containing 3 atomic percent Ni (Example 26) to 58.3° C. for the metallic glass containing 13 atomic percent Ni (Example 31).

Figure 12:
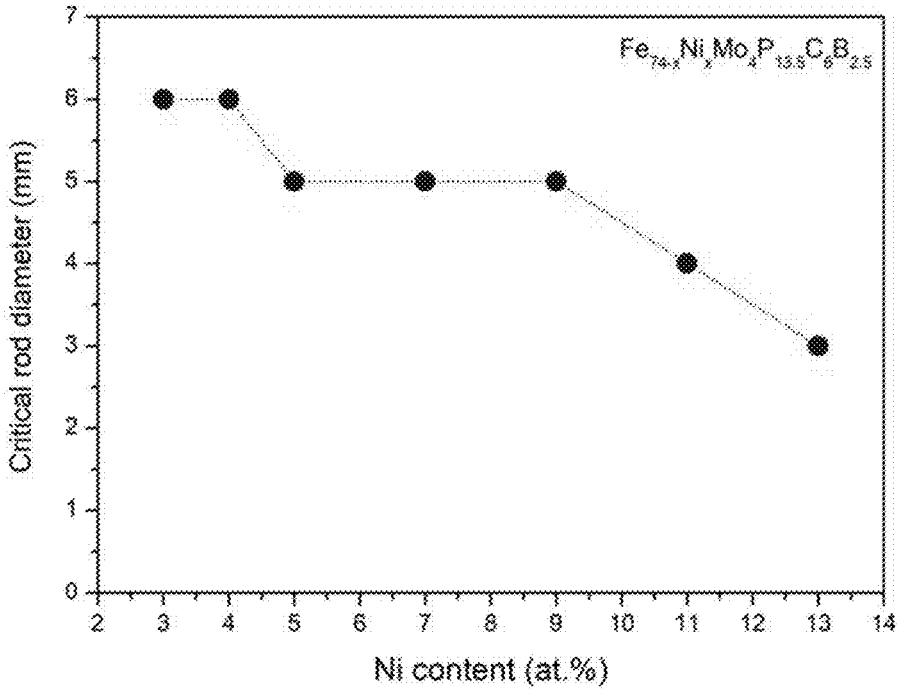
FIG. 12 provides a data plot showing the effect of substituting Fe by Ni according to the composition formula $Fe_{74-x}Ni_xMo_4P_{13.5}C_6B_{2.5}$ on the critical rod diameter of the alloys in accordance with embodiments of the disclosure.

The critical rod diameter of the example alloys according to the composition formula $Fe_{74-x}Ni_xMo_4P_{13.5}C_6B_{2.5}$ is listed in Table 8 and is plotted in FIG. 12. As shown in Table 8 and FIG. 12, substituting Fe by Ni according to $Fe_{74-x}Ni_xMo_4P_{13.5}C_6B_{2.5}$ results in decreasing glass forming ability. Specifically, the critical rod diameter decreases from 6 mm for the metallic glass-forming alloys containing 3-4 atomic percent Ni (Examples 26-27) to 3 mm for the metallic glass-forming alloy containing 13 atomic percent Ni (Example 31).

TABLE 8

Sample metallic glasses demonstrating the effect of substituting Fe by Ni according to the formula $Fe_{74-x}Ni_xMo_4P_{13.5}C_6B_{2.5}$ on the critical rod diameter of the alloy and critical bending diameter of the metallic glass, respectively.

| Example | Composition | Critical Rod Diameter [mm] | Critical Bending Diameter [mm] |
|---|---|---|---|
| 26 | $Fe_{71}Ni_3Mo_4P_{13.5}C_6B_{2.5}$ | 6 | 0.8 |
| 27 | $Fe_{70}Ni_4Mo_4P_{13.5}C_6B_{2.5}$ | 6 | 0.8 |
| 28 | $Fe_{69}Ni_5Mo_4P_{13.5}C_6B_{2.5}$ | 5 | 0.8 |
| 4 | $Fe_{67}Ni_7Mo_4P_{13.5}C_6B_{2.5}$ | 5 | 0.8 |
| 29 | $Fe_{65}Ni_9Mo_4P_{13.5}C_6B_{2.5}$ | 5 | 0.9 |
| 30 | $Fe_{63}Ni_{11}Mo_4P_{13.5}C_6B_{2.5}$ | 4 | 0.9 |
| 31 | $Fe_{61}Ni_{13}Mo_4P_{13.5}C_6B_{2.5}$ | 3 | 0.9 |

The critical bending diameter of the example metallic glasses according to the composition formula $Fe_{74-x}Ni_xMo_4P_{13.5}C_6B_{2.5}$ is also listed in Table 8. As shown in Table 8, substituting Fe by Ni according to $Fe_{74-x}Ni_xMo_4P_{13.5}C_6B_{2.5}$ results in fairly constant bending ductility. Specifically, the critical bending diameter increases slightly from 0.8 mm for the metallic glasses containing 3-7

TABLE 7

Sample metallic glasses demonstrating the effect of substituting Fe by Ni according to the formula $Fe_{74-x}Ni_xMo_4P_{13.5}C_6B_{2.5}$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) | $T_s$ (° C.) | $T_l$ (° C.) |
|---|---|---|---|---|---|---|
| 26 | $Fe_{71}Ni_3Mo_4P_{13.5}C_6B_{2.5}$ | 433.0 | 477.6 | 44.6 | 921.3 | 1010.7 |
| 27 | $Fe_{70}Ni_4Mo_4P_{13.5}C_6B_{2.5}$ | 429.9 | 476.4 | 46.5 | 919.0 | 1007.0 |
| 28 | $Fe_{69}Ni_5Mo_4P_{13.5}C_6B_{2.5}$ | 426.0 | 477.0 | 51.0 | 917.1 | 1004.4 |
| 4 | $Fe_{67}Ni_7Mo_4P_{13.5}C_6B_{2.5}$ | 422.5 | 475.5 | 53.0 | 911.4 | 993.8 |
| 29 | $Fe_{65}Ni_9Mo_4P_{13.5}C_6B_{2.5}$ | 420.1 | 473.4 | 53.3 | 907.0 | 978.7 |
| 30 | $Fe_{63}Ni_{11}Mo_4P_{13.5}C_6B_{2.5}$ | 412.6 | 466.8 | 54.2 | 901.3 | 973.6 |
| 31 | $Fe_{61}Ni_{13}Mo_4P_{13.5}C_6B_{2.5}$ | 410.9 | 469.2 | 58.3 | 909.6 | 966.9 |

atomic percent Ni (Examples 26-28 and 4), to 0.9 mm for the metallic glasses containing 9-13 atomic percent Ni (Examples 29-31).

Specific embodiments of metallic glasses formed of metallic glass-forming alloys with compositions according to the formula $Fe_{65-x}Ni_9Cr_xMo_4P_{13.5}C_6B_{2.5}$ are presented in Tables 5 and 6. In these alloys, Cr is introduced at the expense of Fe, where the atomic fraction of Cr varies from 0 to 10 percent, the atomic fraction of Fe varies from 55 to 65 percent, while the atomic fractions of Ni, Mo, P, C, and B are fixed at 9, 4, 13.5, 6, and 2.5, respectively.

Figure 13:
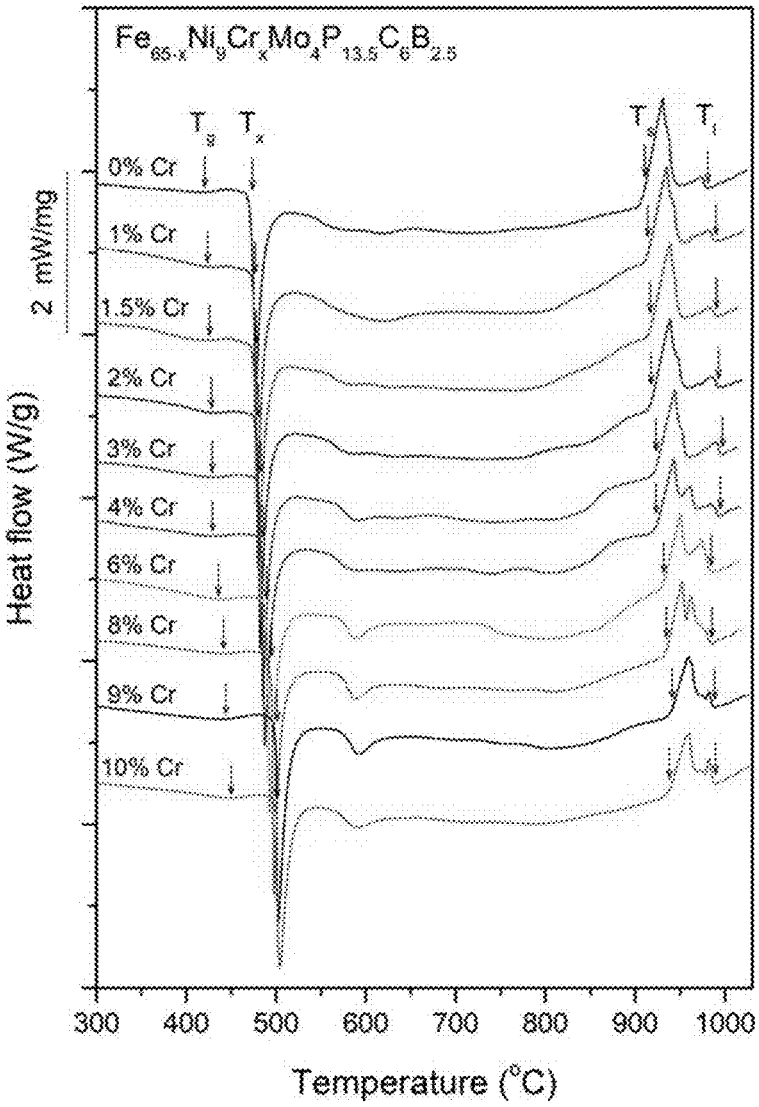
FIG. 13 provides calorimetry scans for sample metallic glasses according to $Fe_{65-x}Ni_9Cr_xMo_4P_{1.35}C_6B_{2.5}$ in accordance with embodiments of the disclosure. The glass transition temperature $T_g$ and crystallization temperature $T_x$ are indicated by arrows.
Figure 14:
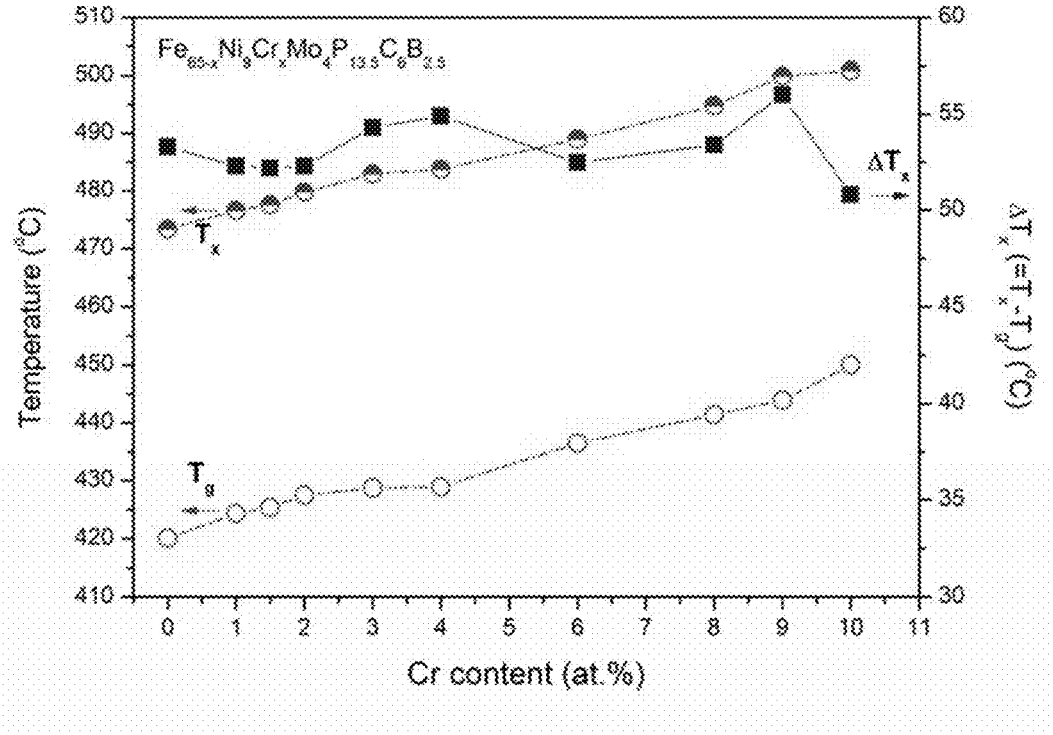
FIG. 14 provides a data plot showing the effect of introducing Cr at the expense of Fe according to the composition formula $Fe_{65-x}Ni_9Cr_xMo_4P_{13.5}C_6B_{2.5}$ on the glass-transition and crystallization temperatures and thermal stability of the supercooled liquid $\Delta T_x$ in accordance with embodiments of the disclosure.

FIG. 13 provides calorimetry scans for sample metallic glasses according to the formula $Fe_{65-x}Ni_9Cr_xMo_4P_{13.5}C_6B_{2.5}$ in accordance with embodiments of the disclosure. The glass transition temperature $T_g$ and crystallization temperature $T_x$ of the metallic glasses are indicated by arrows in FIG. 13, and are listed in Table 9, along with the difference between crystallization and glass-transition temperatures indicating $\Delta T_x = T_x - T_g$. The liquidus temperature $T_l$ and solidus temperature $T_s$ of the alloys are also indicated by arrows in FIG. 13 and are listed in Table 9. FIG. 14 provides a data plot showing the effect of introducing Cr at the expense of Fe according to the composition formula $Fe_{65-x}Ni_9Cr_xMo_4P_{13.5}C_6B_{2.5}$ on the glass-transition and crystallization temperatures and thermal stability of the supercooled liquid $\Delta T_x$ of metallic glasses.

TABLE 9

Sample metallic glasses demonstrating the effect of introducing Cr at the expense of Fe according to the formula $Fe_{65-x}Ni_9Cr_xMo_4P_{13.5}C_6B_{2.5}$ on the glass-transition and crystallization temperatures and thermal stability of the supercooled liquid $\Delta T_x$

| Example | Composition | $T_g$ (° C.) | $T_x$ (° C.) | $\Delta T_x$ (° C.) | $T_s$ (° C.) | $T_l$ (° C.) |
|---|---|---|---|---|---|---|
| 29 | $Fe_{65}Ni_9Mo_4P_{13.5}C_6B_{2.5}$ | 420.1 | 473.4 | 53.3 | 907.0 | 978.7 |
| 32 | $Fe_{64}Ni_9Cr_1Mo_4P_{13.5}C_6B_{2.5}$ | 424.3 | 476.6 | 52.3 | 912.3 | 988.7 |
| 33 | $Fe_{63.5}Ni_9Cr_{1.5}Mo_4P_{13.5}C_6B_{2.5}$ | 425.4 | 477.6 | 52.2 | 914.8 | 989.4 |
| 34 | $Fe_{63}Ni_9Cr_2Mo_4P_{13.5}C_6B_{2.5}$ | 427.5 | 479.8 | 52.3 | 916.3 | 991.9 |
| 35 | $Fe_{62}Ni_9Cr_3Mo_4P_{13.5}C_6B_{2.5}$ | 428.7 | 483.0 | 54.3 | 921.5 | 994.9 |
| 36 | $Fe_{61}Ni_9Cr_4Mo_4P_{13.5}C_6B_{2.5}$ | 428.9 | 483.8 | 54.9 | 922.1 | 992.8 |
| 37 | $Fe_{59}Ni_9Cr_6Mo_4P_{13.5}C_6B_{2.5}$ | 436.5 | 489.0 | 52.5 | 930.5 | 982.2 |
| 38 | $Fe_{57}Ni_9Cr_8Mo_4P_{13.5}C_6B_{2.5}$ | 441.4 | 494.8 | 53.4 | 934.2 | 984.2 |
| 39 | $Fe_{56}Ni_9Cr_9Mo_4P_{13.5}C_6B_{2.5}$ | 443.9 | 499.9 | 56.0 | 939.0 | 986.6 |
| 40 | $Fe_{55}Ni_9Cr_{10}Mo_4P_{13.5}C_6B_{2.5}$ | 450.0 | 500.8 | 50.8 | 937.0 | 987.3 |

As shown in Table 9 and FIGS. 13 and 14, introducing Cr at the expense of Fe according to $Fe_{65-x}Ni_9Cr_xMo_4P_{13.5}C_6B_{2.5}$ results in varying thermal stability of the supercooled liquid. The glass-transition temperature $T_g$ decreases roughly monotonically from 420.1° C. for the Cr-free metallic glass (Example 29) to 450.0° C. for the metallic glass containing 10 atomic percent Cr (Example 40). The crystallization temperature $T_x$ also decreases roughly monotonically from 473.4° C. for the Cr-free metallic glass (Example 29) to 500.8° C. for the metallic glass containing 10 atomic percent Cr (Example 40). The stability for the supercooled liquid $\Delta T_x$ on the other hand fluctuates in the range of 50° to 56° C. as the Cr content ranges between 0 and 10 atomic percent.

Figure 15:
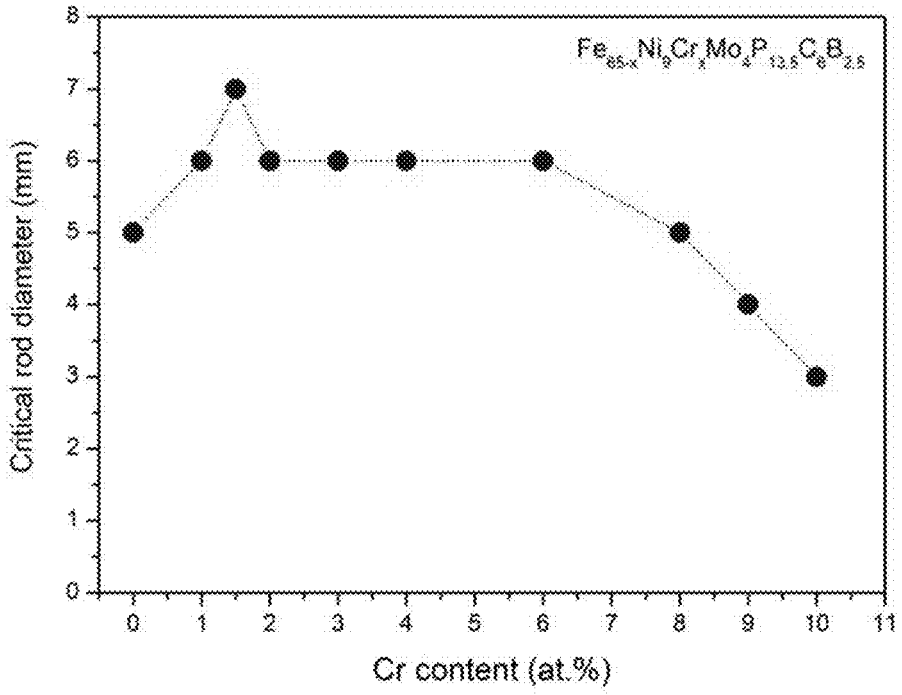
FIG. 15 provides a data plot showing the effect of introducing Cr at the expense of Fe according to the composition formula $Fe_{65-x}Ni_9Cr_xMo_4P_{13.5}C_6B_{2.5}$ on the critical rod diameter of the alloys in accordance with embodiments of the disclosure.

The critical rod diameter of the example alloys according to the composition formula $Fe_{65-x}Ni_9Cr_xMo_4P_{13.5}C_6B_{2.5}$ is listed in Table 10 and is plotted in FIG. 15. As shown in Table 10 and FIG. 15, introducing Cr at the expense of Fe according to $Fe_{65-x}Ni_9Cr_xMo_4P_{13.5}C_6B_{2.5}$ results in varying glass forming ability. Specifically, the critical rod diameter increases gradually from 5 mm for the Cr-free metallic glass-forming alloy (Example 29) to a maximum value of 7 mm for the metallic glass-forming alloy containing 1.5 atomic percent Cr (Example 33), drops back to 6 mm for the metallic glass-forming alloys containing 2-6 atomic percent Cr (Examples 34-37), and finally decreases gradually from 6 to 3 mm as the Cr content increases from 6 to 10 atomic percent (Examples 37-40).

TABLE 10

Sample metallic glasses demonstrating the effect of introducing Cr at the expense of Fe according to the formula $Fe_{65-x}Ni_9Cr_xMo_4P_{13.5}C_6B_{2.5}$ on the critical rod diameter of the alloy and critical bending diameter of the metallic glass, respectively.

| Example | Composition | Critical Rod Diameter [mm] | Critical Bending Diameter [mm] |
|---|---|---|---|
| 29 | $Fe_{65}Ni_9Mo_4P_{13.5}C_6B_{2.5}$ | 5 | 0.9 |
| 32 | $Fe_{64}Ni_9Cr_1Mo_4P_{13.5}C_6B_{2.5}$ | 6 | 0.7 |
| 33 | $Fe_{63.5}Ni_9Cr_{1.5}Mo_4P_{13.5}C_6B_{2.5}$ | 7 | 0.7 |
| 34 | $Fe_{63}Ni_9Cr_2Mo_4P_{13.5}C_6B_{2.5}$ | 6 | 0.6 |
| 35 | $Fe_{62}Ni_9Cr_3Mo_4P_{13.5}C_6B_{2.5}$ | 6 | 0.5 |
| 36 | $Fe_{61}Ni_9Cr_4Mo_4P_{13.5}C_6B_{2.5}$ | 6 | 0.4 |
| 37 | $Fe_{59}Ni_9Cr_6Mo_4P_{13.5}C_6B_{2.5}$ | 6 | 0.3 |
| 38 | $Fe_{57}Ni_9Cr_8Mo_4P_{13.5}C_6B_{2.5}$ | 5 | 0.3 |
| 39 | $Fe_{56}Ni_9Cr_9Mo_4P_{13.5}C_6B_{2.5}$ | 4 | 0.3 |
| 40 | $Fe_{55}Ni_9Cr_{10}Mo_4P_{13.5}C_6B_{2.5}$ | 3 | 0.3 |

The critical bending diameter of the example metallic glasses according to the composition formula $Fe_{65}$-$xNi_9Cr_xMo_4P_{13.5}C_6B_{2.5}$ is also listed in Table 10. As shown in Table 10, introducing Cr at the expense of Fe according to $Fe_{65}$-$xNi_9Cr_xMo_4P_{13.5}C_6B_{2.5}$ results in decreasing bending ductility. Specifically, the critical bending diameter decreases from 0.9 mm for the Cr-free metallic glass (Example 29), to 0.7 mm for the metallic glasses containing 1-1.5 atomic percent Cr (Examples 32 and 33), to 0.6 mm for the metallic glass containing 2 atomic percent Cr (Example 34)), to 0.5 mm for the metallic glass containing 3 atomic percent Cr (Example 35), to 0.4 mm for the metallic glass containing 4 atomic percent Cr (Example 36), to 0.3 mm for the metallic glasses containing 6-10 atomic percent Cr (Examples 37-40).

Specific embodiments of metallic glasses formed of metallic glass-forming alloys with compositions according to the formula $[Fe_{0.814}Ni_{0.116}Cr_{0.019}Mo_{0.051}]_{100-x}[P_{0.613}C_{0.273}B_{0.114}]_x$ are presented in Tables 11 and 12. In these alloys, metals are substituted by metalloids, where the atomic fraction of metalloids (combined fractions of P, C, and B), denoted by x, varies from 21 to 24 percent, while the atomic fraction of metals (combined atomic fractions Fe, Ni, Cr, Mo), (1−x), varies from 76 to 79 percent.

Figure 16:
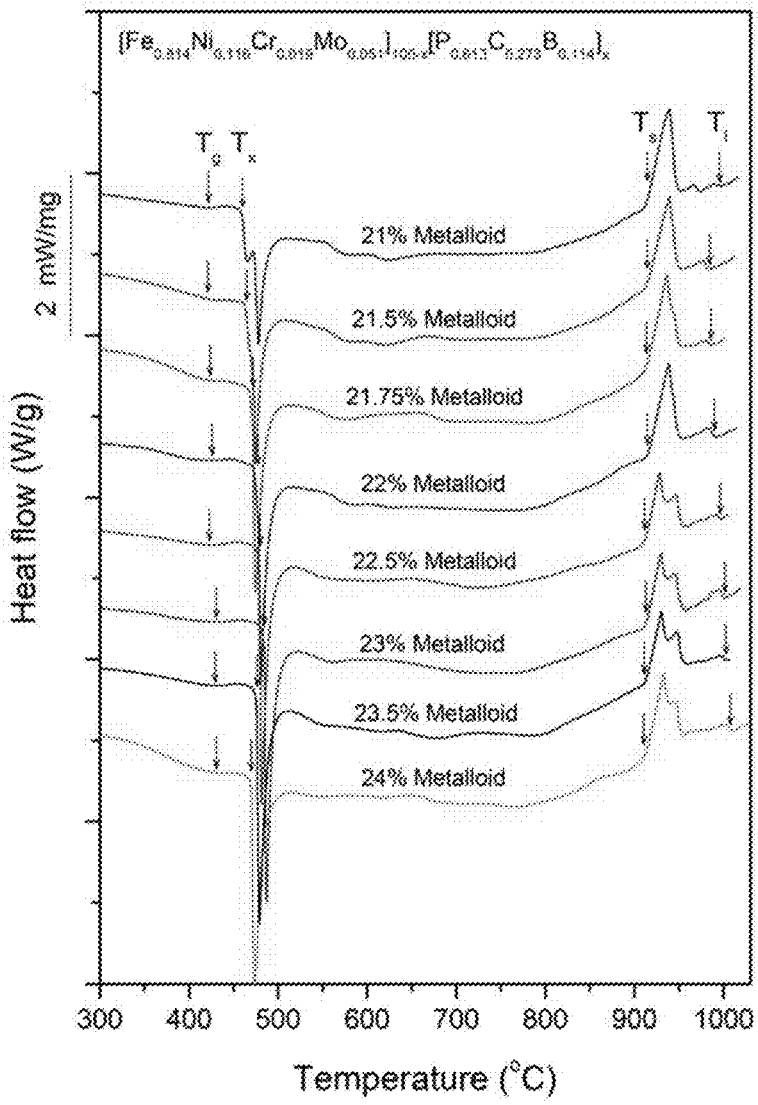
FIG. 16 provides calorimetry scans for sample metallic glasses according to $[Fe_{0.814}Ni_{0.116}Cr_{0.019}Mo_{0.051}]_{100-x}$ $[P_{0.613}C_{0.273}B_{0.114}]_x$ in accordance with embodiments of the disclosure. The glass transition temperature $T_g$ and crystallization temperature $T_x$ are indicated by arrows.
Figure 17:
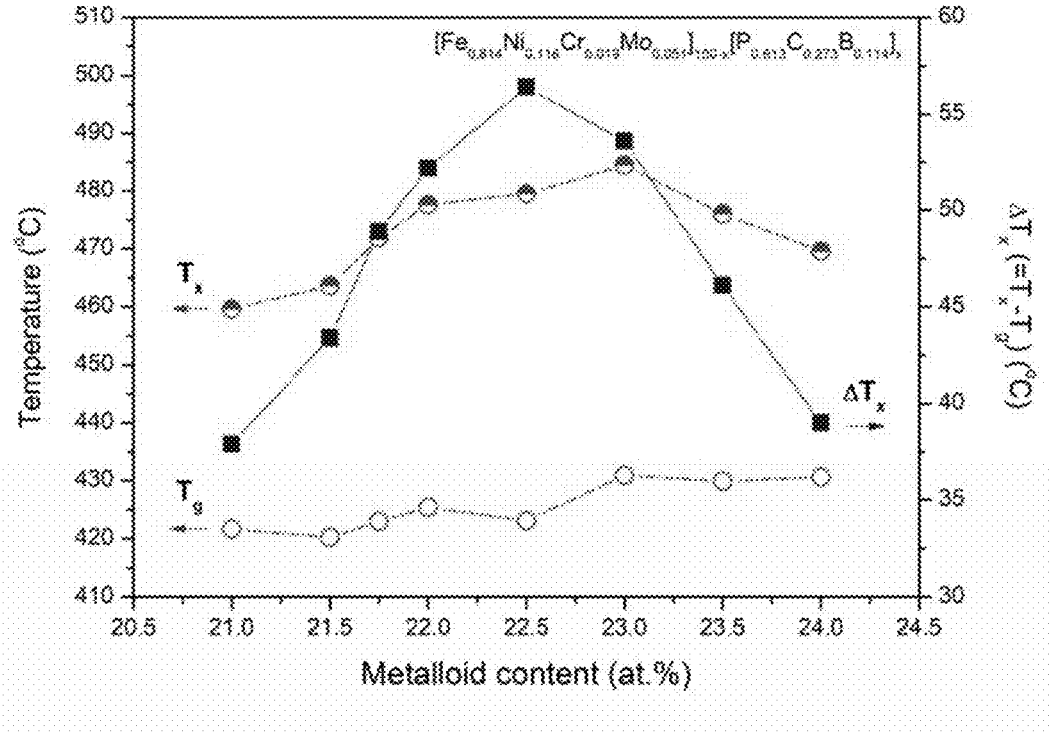
FIG. 17 provides a data plot showing the effect of substituting metals by metalloids according to the composition formula $[Fe_{0.814}Ni_{0.116}Cr_{0.019}Mo_{0.051}]_{100-x}[P_{0.613}C_{0.273}B_{0.114}]_x$ on the glass-transition and crystallization temperatures and thermal stability of the supercooled liquid $\Delta T_x$ in accordance with embodiments of the disclosure.

FIG. 16 provides calorimetry scans for sample metallic glasses according to the formula $[Fe_{0.814}Ni_{0.116}Cr_{0.019}Mo_{0.051}]_{100-x}[P_{0.613}C_{0.273}B_{0.114}]_x$ in accordance with embodiments of the disclosure. The glass transition temperature $T_g$ and crystallization temperature $T_x$ of the metallic glasses are indicated by arrows in FIG. 17, and are listed in Table 11, along with the difference between crystallization and glass-transition temperatures indicating $\Delta T_x = T_x - T_g$. The liquidus temperature $T_l$ and solidus temperature $T_s$ of the alloys are also indicated by arrows in FIG. 16 and are listed in Table 11. FIG. 17 provides a data plot showing the effect of substituting metals by metalloids according to the composition formula $[Fe_{0.814}Ni_{0.116}Cr_{0.019}Mo_{0.051}]_{100-x}[P_{0.613}C_{0.273}B_{0.114}]_x$ on the glass-transition and crystallization temperatures and thermal stability of the supercooled liquid $\Delta T_x$ of metallic glasses.

TABLE 11

Sample metallic glasses demonstrating the effect of substituting metals by metalloids according to the formula $[Fe_{0.814}Ni_{0.116}Cr_{0.019}Mo_{0.051}]_{100-x}[P_{0.613}C_{0.273}B_{0.114}]_x$ on the glass-transition and crystallization temperatures and thermal stability of the supercooled liquid $\Delta T_x$

| Example | Composition | x (—) | $T_g$ (° C.) | $T_x$ (° C.) | $\Delta T_x$ (° C.) | $T_s$ (° C.) | $T_l$ (° C.) |
|---|---|---|---|---|---|---|---|
| 41 | $Fe_{64.31}Ni_{9.12}Cr_{1.52}Mo_{4.05}P_{12.88}C_{5.73}B_{2.39}$ | 21 | 421.7 | 459.6 | 37.9 | 913.3 | 997.1 |
| 42 | $Fe_{63.9}Ni_{9.06}Cr_{1.51}Mo_{4.03}P_{13.19}C_{5.87}B_{2.44}$ | 21.5 | 420.2 | 463.6 | 43.4 | 914.2 | 981.9 |
| 43 | $Fe_{63.7}Ni_{9.03}Cr_{1.51}Mo_{4.01}P_{13.35}C_{5.93}B_{2.47}$ | 21.75 | 423.0 | 471.9 | 48.9 | 911.7 | 984.7 |
| 33 | $Fe_{63.5}Ni_9Cr_{1.5}Mo_4P_{13.5}C_6B_{2.5}$ | 22 | 425.4 | 477.6 | 52.2 | 914.8 | 989.4 |
| 44 | $Fe_{63.1}Ni_{8.94}Cr_{1.49}Mo_{3.97}P_{13.81}C_{6.13}B_{2.56}$ | 22.5 | 423.1 | 479.5 | 56.4 | 911.5 | 996.0 |
| 45 | $Fe_{62.69}Ni_{8.88}Cr_{1.48}Mo_{3.95}P_{14.12}C_{6.27}B_{2.61}$ | 23 | 430.9 | 484.5 | 53.6 | 912.9 | 1000.7 |
| 46 | $Fe_{62.28}Ni_{8.83}Cr_{1.47}Mo_{3.92}P_{14.42}C_{6.41}B_{2.67}$ | 23.5 | 429.9 | 476.0 | 46.1 | 913.1 | 1002.5 |
| 47 | $Fe_{61.87}Ni_{8.77}Cr_{1.46}Mo_{3.9}P_{14.73}C_{6.54}B_{2.73}$ | 24 | 430.6 | 469.6 | 39.0 | 911.2 | 1008.0 |

As shown in Table 11 and FIGS. 16 and 17, substituting metals by metalloids according to $[Fe_{0.814}Ni_{0.116}Cr_{0.019}Mo_{0.051}]_{100-x}[P_{0.613}C_{0.273}B_{0.114}]_x$ results in strongly varying thermal stability of the supercooled liquid. The glass-transition temperature $T_g$ fluctuates between 420.2° C. and 425.4° C. for the metallic glasses containing 21 to 22.5 atomic percent metalloids x (Examples 33 and 41-44), jumps to 430.9° C. for the metallic glass containing 23% atomic percent metalloids x (Example 45), and fluctuates slightly in the range of 429.9° C. and 430.9° C. for the metallic glasses containing 23 to 24 atomic percent metalloids x (Examples 45-47). The crystallization temperature $T_x$ increases gradually from 459.6° C. for the metallic glass containing 21 atomic percent metalloids x (Example 41) to a maximum value of 484.5° C. for the metallic glass containing 23 atomic percent metalloids x (Example 45), and decreases gradually back to 469.6° C. for the metallic glass containing 24 atomic percent metalloids x (Example 47). Because of a dependence of the crystallization temperature $T_x$ on metalloid content x that involves a peak, and because a dependence of the glass-transition temperature $T_g$ on metalloid content x that involves an abrupt increase at high metalloid contents, the stability for the supercooled liquid $\Delta T_x = T_x - T_g$ has an unexpectedly steep dependence on metalloid content x that involves a very sharp peak. Specifically, the stability for the supercooled liquid $\Delta T_x$ increases sharply from 37.9° C. for the metallic glass containing 21 atomic percent metalloids x (Example 41) to a maximum value of 56.4° C. for the metallic glass containing 22.5 atomic percent metalloids x (Example 44), and decreases sharply back to 39.0° C. for the metallic glass containing 24 atomic percent metalloids x (Example 47). Therefore, as the metalloid content increases from 21 to 22.5 atomic percent (i.e. 1.5 atomic percent), the stability for the supercooled liquid $\Delta T_x$ increases by 18.5° C. (i.e. by 49%) to reach the peak value of 56.4° C. On the opposite end, as the metalloid content decreases from 24 to 22.5 atomic percent (i.e. 1.5 atomic percent), $\Delta T_x$ increases by 17.4° C. (i.e. by 30%) to reach the peak value of 56.4° C. Such sharp change in $\Delta T_x$ over such narrow compositional change is unusual and unexpected.

Figure 18:
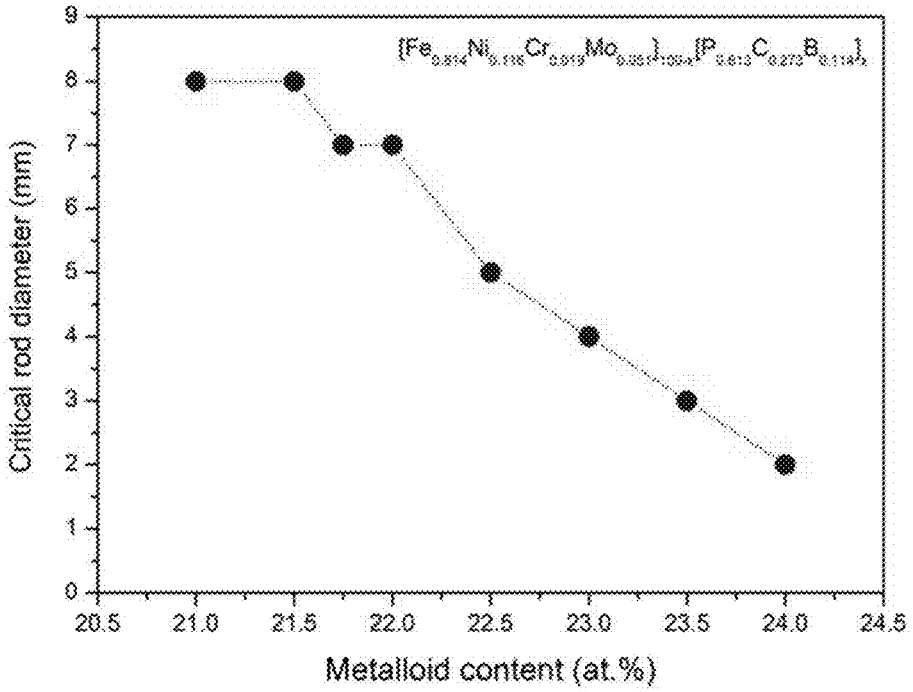
FIG. 18 provides a data plot showing the effect of substituting metals by metalloids according to the composition formula $[Fe_{0.814}Ni_{0.116}Cr_{0.019}Mo_{0.051}]_{100-x}[P_{0.613}C_{0.273}B_{0.114}]_x$ on the critical rod diameter of the alloys in accordance with embodiments of the disclosure.

The critical rod diameter of the example alloys according to the composition formula $[Fe_{0.814}Ni_{0.116}Cr_{0.019}Mo_{0.051}]_{100-x}[P_{0.613}C_{0.273}B_{0.114}]_x$ is listed in Table 12 and is plotted in FIG. 18. As shown in Table 12 and FIG. 18, substituting metals by metalloids according to $[Fe_{0.814}Ni_{0.116}Cr_{0.019}Mo_{0.051}]_{100-x}[P_{0.613}C_{0.273}B_{0.114}]_x$ results in decreasing glass forming ability. Specifically, the critical rod diameter decreases gradually from 8 mm for the metallic glass-forming alloys containing 21-21.5 atomic percent metalloids x (Examples 41-42) to 2 mm for the metallic glass-forming alloy containing 24 atomic percent metalloids x (Example 47).

TABLE 12

Sample metallic glasses demonstrating the effect of substituting metals by metalloids according to the formula $[Fe_{0.814}Ni_{0.116}Cr_{0.019}Mo_{0.051}]_{100-x}[P_{0.613}C_{0.273}B_{0.114}]_x$ on the critical rod diameter of the alloy and critical bending diameter of the metallic glass,, respectively.

| Example | Composition | x (—) | Critical Rod Diameter [mm] | Critical Bending Diameter [mm] |
|---|---|---|---|---|
| 41 | $Fe_{64.31}Ni_{9.12}Cr_{1.52}Mo_{4.05}P_{12.88}C_{5.73}B_{2.39}$ | 21 | 8 | 0.8 |
| 42 | $Fe_{63.9}Ni_{9.06}Cr_{1.51}Mo_{4.03}P_{13.19}C_{5.87}B_{2.44}$ | 21.5 | 8 | 0.8 |
| 43 | $Fe_{63.7}Ni_{9.03}Cr_{1.51}Mo_{4.01}P_{13.35}C_{5.93}B_{2.47}$ | 21.75 | 7 | 0.7 |

TABLE 12-continued

Sample metallic glasses demonstrating the effect of substituting metals by metalloids according to the formula $[Fe_{0.814}Ni_{0.116}Cr_{0.019}Mo_{0.051}]_{100-x}[P_{0.613}C_{0.273}B_{0.114}]_x$ on the critical rod diameter of the alloy and critical bending diameter of the metallic glass,, respectively.

| Example | Composition | x (—) | Critical Rod Diameter [mm] | Critical Bending Diameter [mm] |
|---|---|---|---|---|
| 33 | $Fe_{63.5}Ni_9Cr_{1.5}Mo_4P_{13.35}C_6B_{2.5}$ | 22 | 7 | 0.7 |
| 44 | $Fe_{63.1}Ni_{8.94}Cr_{1.49}Mo_{3.97}P_{13.81}C_{6.13}B_{2.56}$ | 22.5 | 5 | 0.7 |
| 45 | $Fe_{62.69}Ni_{8.88}Cr_{1.48}Mo_{3.95}P_{14.12}C_{6.27}B_{2.61}$ | 23 | 4 | 0.6 |
| 46 | $Fe_{62.28}Ni_{8.83}Cr_{1.47}Mo_{3.92}P_{14.42}C_{6.41}B_{2.67}$ | 23.5 | 3 | 0.6 |
| 47 | $Fe_{61.87}Ni_{8.77}Cr_{1.46}Mo_{3.9}P_{14.73}C_{6.54}B_{2.73}$ | 24 | 2 | 0.5 |

The critical bending diameter of the example metallic glasses according to the composition formula $[Fe_{0.814}Ni_{0.116}Cr_{0.019}Mo_{0.051}]_{100-x}[P_{0.613}C_{0.273}B_{0.114}]_x$ is also listed in Table 12. As shown in Table 12, substituting metals by metalloids according to $[Fe_{0.814}Ni_{0.116}Cr_{0.019}Mo_{0.051}]_{100-x}[P_{0.613}C_{0.273}B_{0.114}]_x$ results in decreasing bending ductility. Specifically, the critical bending diameter decreases from 0.8 mm for the metallic glasses containing 21-21.5 atomic percent metalloids x (Examples 41 and 42), to 0.7 mm for the metallic glasses containing 21.75-22.5 atomic percent metalloids x (Examples 33, 43 and 44), to 0.6 mm for the metallic glasses containing 23-23.5 atomic percent metalloids x (Examples 45 and 46), to 0.5 mm for the metallic glass containing 24 atomic percent metalloids x (Example 47).

Figure 19:
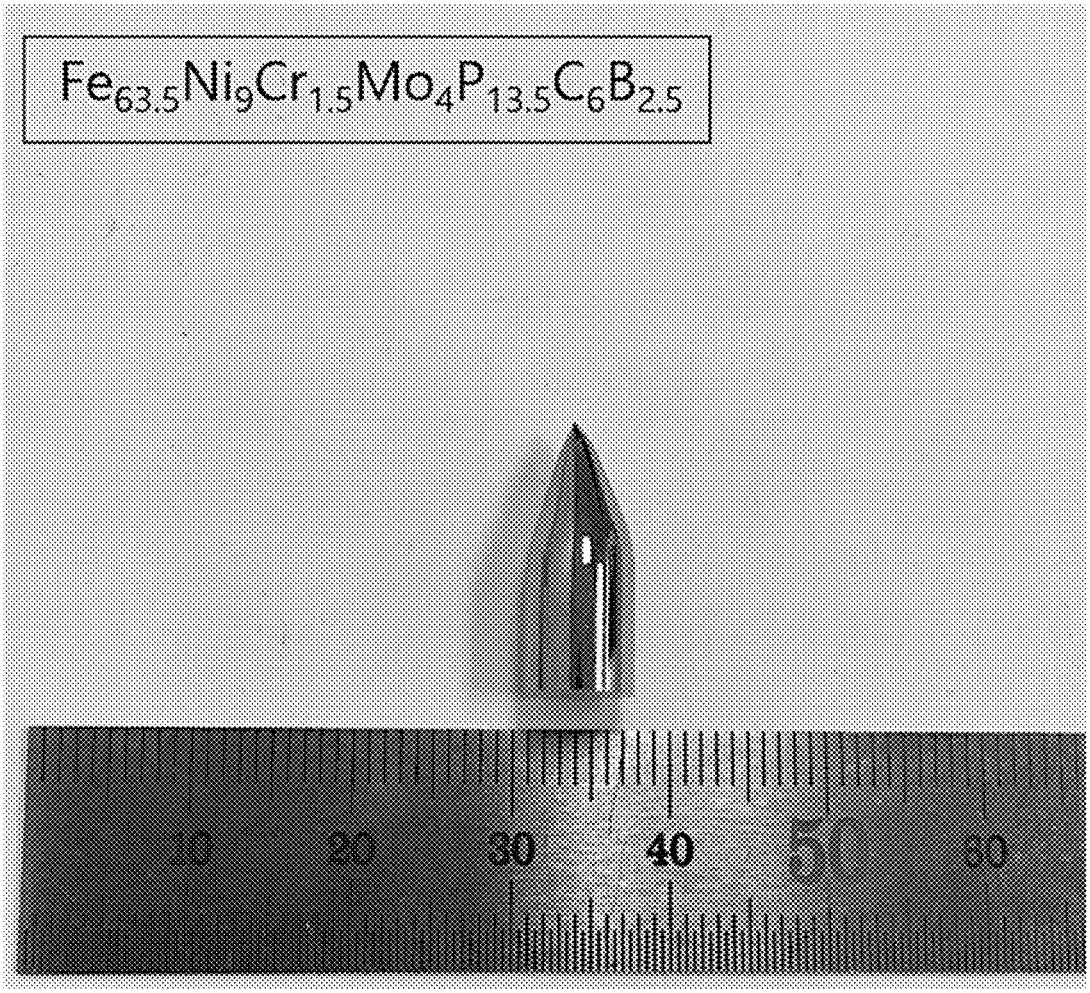
FIG. 19 illustrates a 7 mm rod of metallic glass $Fe_{63.5}Ni_9Cr_{1.5}Mo_4P_{13.5}C_6B_{2.5}$ (Example 33) processed by water quenching the high temperature melt in a fused silica tube having a wall thickness of 0.5 mm.
Figure 20:
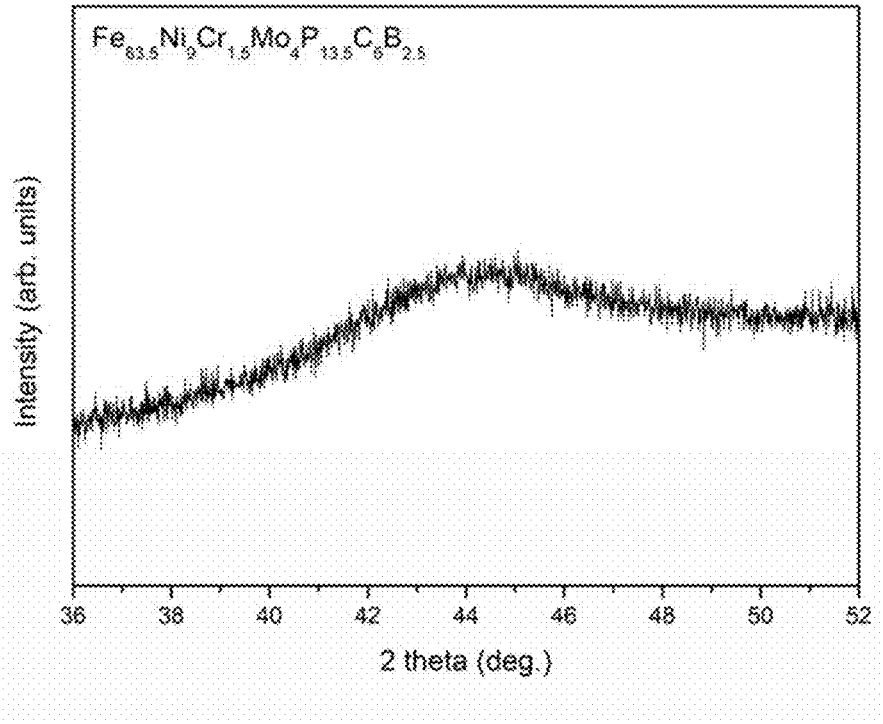
FIG. 20 illustrates an x-ray diffractogram verifying the amorphous structure a 7 mm rod of metallic glass $Fe_{63.5}Ni_9Cr_{1.5}Mo_4P_{13.5}C_6B_{2.5}$ (Example 33).
Figure 21:
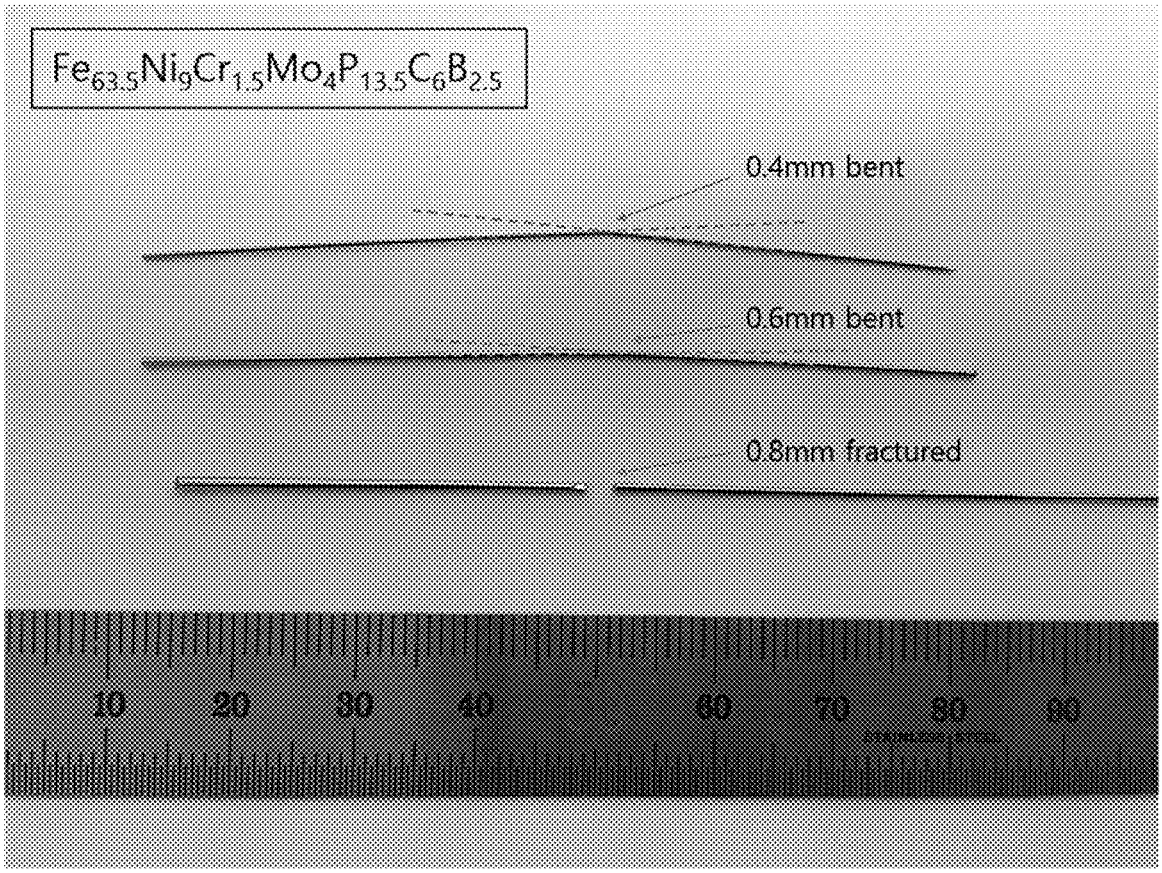
FIG. 21 illustrates a plastically-bent 0.4 mm diameter rod of metallic glass $Fe_{63.5}Ni_9Cr_{1.5}Mo_4P_{13.5}C_6B_{2.5}$ (Example 33), a plastically-bent 0.6 mm diameter rod of metallic glass $Fe_{63.5}Ni_9Cr_{1.5}Mo_4P_{13.5}C_6B_{2.5}$ (Example 33), and a fractured 0.8 mm diameter rod of metallic glass $Fe_{63.5}Ni_9Cr_{1.5}Mo_4P_{13.5}C_6B_{2.5}$ (Example 33).

FIG. 19 illustrates a 7 mm rod of metallic glass $Fe_{63.5}Ni_9Cr_{1.5}Mo_4P_{13.5}C_6B_{2.5}$ (Example 33) processed by water quenching the high temperature melt in a fused silica tube having a wall thickness of 0.5 mm. FIG. 20 illustrates an x-ray diffractogram verifying the amorphous structure of the 7 mm diameter rod illustrated in FIG. 19. FIG. 21 illustrates a plastically-bent 0.4 mm diameter rod of metallic glass $Fe_{63.5}Ni_9Cr_{1.5}Mo_4P_{13.5}C_6B_{2.5}$ (Example 33), a plastically-bent 0.6 mm diameter rod of metallic glass $Fe_{63.5}Ni_9Cr_{1.5}Mo_4P_{13.5}C_6B_{2.5}$ (Example 33), and a fractured 0.8 mm diameter rod of metallic glass $Fe_{63.5}Ni_9Cr_{1.5}Mo_4P_{13.5}C_6B_{2.5}$ (Example 33). These results reveal that rods of metallic glass $Fe_{63.5}Ni_9Cr_{1.5}Mo_4P_{13.5}C_6B_{2.5}$ (Example 33) with diameters of up to 0.7 mm are capable of being plastically bent, while rods with diameters of greater than 0.7 mm are incapable of being plastically bent and consequently fracture, hence suggesting a critical bending diameter for metallic glass $Fe_{63.5}Ni_9Cr_{1.5}Mo_4P_{13.5}C_6B_{2.5}$ (Example 33) of 0.7 mm.

Description of Methods of Processing the Example Alloys

The particular method for producing the alloy ingots involves inductive melting of the appropriate amounts of elemental constituents in a quartz tube under inert atmosphere. The purity levels of the constituent elements were as follows: Fe 99.95%, Cr 99.996% (crystalline), Ni 99.995%, Mo 99.95%, P 99.9999%, C 99.9995%, and B 99.5%. The melting crucible may alternatively be a ceramic such as alumina or zirconia, graphite, sintered crystalline silica, or a water-cooled hearth made of copper or silver.

The particular method for producing the rods of metallic glasses from the alloy ingots involves re-melting the alloy ingots in quartz tubes having 0.5 mm thick walls in a furnace at 1350° C. under high purity argon and rapidly quenching in a room-temperature water bath. Alternatively, the bath could be ice water or oil. Metallic glass articles could be alternatively formed by injecting or pouring the molten alloy into a metal mold. The mold could be made of copper, brass, or steel, among other materials.

In some embodiments, prior to producing a metallic glass article, the alloyed ingots could be fluxed with a reducing agent by re-melting the ingots in a quartz tube under inert atmosphere, bringing the alloy melt in contact with the molten reducing agent, and allowing the two melts to interact for about 1000 s at a temperature of about 1200° C. or higher, and subsequently water quenching. In one embodiment, the reducing agent is boron oxide.

Test Methodology for Assessing Glass-Forming Ability

The glass-forming ability of each alloy was assessed by determining the maximum rod diameter in which the amorphous phase of the alloy (i.e. the metallic glass phase) could be formed when processed by the methods described above. X-ray diffraction with Cu-Kα radiation was performed to verify the amorphous structure of the alloys.

Test Methodology for Assessing Bending Ductility

The bending ductility of each metallic glass was assessed by determining the maximum rod diameter in which the metallic glass subject to a bending load is capable of permanently (i.e. irreversibly, inelastically) bending without fracturing catastrophically.

Test Methodology for Differential Scanning Calorimetry

Differential scanning calorimetry was performed on sample metallic glasses at a scan rate of 20 K/min to determine the glass-transition and crystallization temperatures of sample metallic glasses formed from the glass-forming alloys, and also to determine the solidus and liquidus temperatures of the alloys.

Having described several embodiments, it will be recognized by those skilled in the art that various modifications, alternative constructions, and equivalents may be used without departing from the spirit of the disclosure. Those skilled in the art will appreciate that the presently disclosed embodiments teach by way of example and not by limitation. Therefore, the matter contained in the above description or shown in the accompanying drawings should be interpreted as illustrative and not in a limiting sense. Additionally, a number of well-known processes and elements have not been described in order to avoid unnecessarily obscuring the disclosure.

The following claims are intended to cover all generic and specific features described herein, as well as all statements of the scope of the present method and system, which, as a matter of language, might be said to fall therebetween.

What is claimed is:

1. A metallic glass-forming alloy having a composition represented by the following formula:

$$Fe_{(100-a-b-c-d-e-f)}Cr_aNi_bMo_cP_dC_eB_f$$

where:

a is up to 10 atomic percent, b ranges from 3 to 13 atomic percent, c ranges from 2 to 7 atomic percent, d+e+f ranges from 21.25 to 23.75 atomic percent, e ranges from 4.5 to 8; atomic percent, f ranges from 1 to 9 atomic percent; and wherein the metallic glass-forming alloy has a critical rod diameter of at least 3 mm, and wherein the thermal stability of the supercooled liquid of a metallic glass formed from the metallic glass-forming alloy against crystallization is at least 45° C.

2. The metallic glass-forming alloy of claim 1, wherein a is up to 9 atomic percent, b ranges from 4 to 12 atomic percent, c ranges from 3 to 6.5 atomic percent, d+e+f ranges from 21.5 to 23.5 atomic percent, e ranges from 5.25 to 7.5 atomic percent, and f ranges from 1.5 to 8.5 atomic percent, wherein the metallic glass-forming alloy has a critical rod diameter of at least 4 mm, and wherein the thermal stability of the supercooled liquid of the metallic glass forming alloy formed from the metallic glass-forming alloy against crystallization is at least 47.5° C.

3. The metallic glass-forming alloy of claim 1, wherein a is less than 3.5 atomic percent, and wherein the critical bending diameter of the metallic glass formed from the metallic glass-forming alloy is at least 0.5 mm.

4. The metallic glass-forming alloy of claim 1, wherein c ranges from 2 to less than 6.5 atomic percent, and wherein the critical bending diameter of the metallic glass formed from the metallic glass-forming alloy is at least 0.6 mm.

5. The metallic glass-forming alloy of claim 1, wherein d+e+f ranges from 21.25 to less than 23.5 atomic percent, and wherein the critical bending diameter of the metallic glass formed from the metallic glass-forming alloy is at least 0.6 mm.

6. The metallic glass-forming alloy of claim 1, wherein e ranges from greater than 5.25 to 8 atomic percent, and wherein the critical bending diameter of the metallic glass formed from the metallic glass-forming alloy is at least 0.8 mm.

7. The metallic glass-forming alloy of claim 1, wherein f ranges from 1 to less than 5 atomic percent, and wherein the critical bending diameter of the metallic glass formed from the metallic glass-forming alloy is at least 0.5 mm.

8. A metallic glass-forming alloy having a composition represented by the following formula:

$$Fe_{(100-a-b-c-d-e-f-g)}Cr_aNi_bMo_cP_dC_eB_fX_g$$

where:

a is up to 10 atomic percent, b ranges from 3 to 13 atomic percent, c ranges from 2 to 7 atomic percent, d+e+f ranges from 21.25 to 23.75 atomic percent, e ranges from 4.5 to 8; atomic percent f ranges from 1 to 9 atomic percent;

wherein X is selected from the group consisting of Co, Ru, Mn, and any combinations thereof; wherein the atomic percent g of the element X is up to 5;

wherein the metallic glass-forming alloy has a critical rod diameter of at least 3 mm; and wherein the thermal stability of the supercooled liquid of a metallic glass formed from the metallic glass-forming alloy against crystallization is at least 45° C.

9. A metallic glass-forming alloy having a composition represented by the following formula:

$$Fe_{(100-a-b-c-d-e-f-g)}Cr_aNi_bMo_cP_dC_eB_fX_g$$

where:

a is up to 10 atomic percent, b ranges from 3 to 13 atomic percent, c ranges from 2 to 7 atomic percent, d+e+f ranges from 21.25 to 23.75 atomic percent, e ranges from 4.5 to 8; atomic percent f ranges from 1 to 9 atomic percent;

wherein X is selected from the group consisting of Pd, Pt, Si, and any combinations thereof; wherein the atomic percent g of the element X is up to 2;

wherein the metallic glass-forming alloy has a critical rod diameter of at least 3 mm; and wherein the thermal stability of the supercooled liquid of a metallic glass formed from the metallic glass-forming alloy against crystallization is at least 45° C.

10. A metallic glass-forming alloy having a composition represented by the following formula:

$$Fe_{(100-a-b-c-d-e-f-g)}Cr_aNi_bMo_cP_dC_eB_fX_g$$

where:

a is up to 10 atomic percent, b ranges from 3 to 13 atomic percent, c ranges from 2 to 7 atomic percent, d+e+f ranges from 21.25 to 23.75 atomic percent, e ranges from 4.5 to 8; atomic percent f ranges from 1 to 9 atomic percent;

wherein X is selected from the group consisting of Nb, Ta, V, W, and any combinations thereof; wherein the atomic percent g of the element X is up to 1;

wherein the metallic glass-forming alloy has a critical rod diameter of at least 3 mm; and wherein the thermal stability of the supercooled liquid of a metallic glass formed from the metallic glass-forming alloy against crystallization is at least 45° C.

* * * * *